US008353356B2

(12) United States Patent
Rogers

(10) Patent No.: US 8,353,356 B2
(45) Date of Patent: Jan. 15, 2013

(54) RESIDENTIAL FLAT PLATE CONCEALED SPRINKLER

(75) Inventor: Kenneth W. Rogers, Horsham, PA (US)

(73) Assignee: Tyco Fire Products LP, Lansdale, PA (US)

( * ) Notice: Subject to any disclaimer, the term of this patent is extended or adjusted under 35 U.S.C. 154(b) by 578 days.

(21) Appl. No.: 11/916,405

(22) PCT Filed: Jun. 5, 2006

(86) PCT No.: PCT/US2006/021682

§ 371 (c)(1), (2), (4) Date: Jul. 31, 2008

(87) PCT Pub. No.: WO2006/133057

PCT Pub. Date: Dec. 14, 2006

(65) Prior Publication Data

US 2009/0126950 A1 May 21, 2009

Related U.S. Application Data

(60) Provisional application No. 60/686,971, filed on Jun. 3, 2005.

(51) Int. Cl.

| | |
|---|---|
| ***A62C 37/08*** | (2006.01) |
| ***A62C 37/50*** | (2006.01) |
| ***A62C 2/00*** | (2006.01) |
| ***A62C 37/12*** | (2006.01) |
| ***B05B 1/26*** | (2006.01) |

(52) U.S. Cl. ..... 169/37; 169/90; 169/39; 169/40; 169/47; 169/57; 239/504; 239/510; 239/512; 239/515; 239/524

(58) Field of Classification Search ..... 169/37, 169/46, 47, 56, 57, 38, 39, 40, 90; 239/504, 239/505, 507, 510, 512, 514, 515, 518, 524
See application file for complete search history.

(56) References Cited

U.S. PATENT DOCUMENTS 306,662 A 10/1884 Stratton (Continued)

FOREIGN PATENT DOCUMENTS

EP 0 505 672 9/1992

(Continued)

OTHER PUBLICATIONS

Extended European Search Report of counterpart EP Application No. 06772108.4 includes the supplementary European search report and the European search opinion; Jun. 4, 2009; 14 pages.

(Continued)

*Primary Examiner* — Len Tran
*Assistant Examiner* — Steven M Cernoch
(74) *Attorney, Agent, or Firm* — Perkins Coie LLP

(57) ABSTRACT

A pendant sprinkler preferably includes a body having an inner surface defining a passageway. The passageway includes an inlet and an outlet spaced apart along the longitudinal axis and defines a K-factor of about 5. The sprinkler also includes a closure assembly adjacent the outlet to occlude the outlet and a thermally responsive support means for maintaining the closure assembly adjacent the outlet. Also provided are means for distributing a flow of fluid over a protection area ranging from about 144 square feet to about 400 square feet, the fluid distribution having a density of at least 0.05 gallons per minute per square foot (0.05 gpm/ft$^2$) so as to define a range of minimum operating pressures ranging from about seven pounds per square inch to about seventeen pounds per square inch (7-17 psi.) and a range of minimum operating fluid flows ranging from about thirteen gallons per minute to about twenty gallons per minute (13-20 gpm.). The sprinkler preferably includes a thermally responsive plate means for maintaining a minimum spacing between the outlet and the means for distributing.

79 Claims, 8 Drawing Sheets

U.S. PATENT DOCUMENTS

| | | | | | |
|---|---|---|---|---|---|
| 316,581 | A | | 4/1885 | Stratton | |
| 2,135,138 | A | | 11/1938 | Kendall | |
| 3,195,647 | A | * | 7/1965 | Campbell et al. | 169/40 |
| 3,309,028 | A | * | 3/1967 | Zieg et al. | 239/498 |
| 3,459,266 | A | * | 8/1969 | Ault | 169/37 |
| 3,633,676 | A | * | 1/1972 | Gloeckler | 169/40 |
| 3,714,989 | A | * | 2/1973 | Gloeckler | 169/19 |
| 4,014,388 | A | * | 3/1977 | Anderson | 169/37 |
| 4,015,665 | A | | 4/1977 | Simons et al. | |
| 4,066,129 | A | * | 1/1978 | Anderson | 169/37 |
| 4,139,062 | A | | 2/1979 | Rago | |
| 4,440,234 | A | * | 4/1984 | Shea | 169/39 |
| 4,491,182 | A | | 1/1985 | Pieczkolan | |
| 4,508,175 | A | * | 4/1985 | Pieczykolan | 169/38 |
| 4,580,729 | A | | 4/1986 | Pounder | |
| 4,596,289 | A | * | 6/1986 | Johnson | 169/37 |
| 4,715,447 | A | | 12/1987 | Johnson | |
| 4,880,063 | A | * | 11/1989 | Leininger et al. | 169/37 |
| 4,976,320 | A | | 12/1990 | Polan | |
| 5,152,344 | A | | 10/1992 | Fischer et al. | |
| 5,579,846 | A | | 12/1996 | Meyer et al. | |
| 5,584,344 | A | | 12/1996 | Meyer et al. | |
| 5,609,211 | A | | 3/1997 | Meyer et al. | |
| 5,664,630 | A | * | 9/1997 | Meyer et al. | 169/37 |
| 5,687,914 | A | | 11/1997 | Bosio | |
| 5,839,667 | A | | 11/1998 | Fishcer | |
| 5,865,256 | A | | 2/1999 | Pounder | |
| 6,026,907 | A | | 2/2000 | Pahila | |
| 6,059,044 | A | | 5/2000 | Fischer | |
| 6,082,463 | A | * | 7/2000 | Ponte | 169/41 |
| 6,152,236 | A | * | 11/2000 | Retzloff et al. | 169/57 |
| 6,276,460 | B1 | | 8/2001 | Pahila | |
| 6,367,559 | B1 | | 4/2002 | Winebrenner | |
| 6,516,893 | B2 | | 2/2003 | Pahila | |
| 6,840,329 | B2 | * | 1/2005 | Kikuchi et al. | 169/37 |
| 6,854,668 | B2 | | 2/2005 | Wancho et al. | |
| 7,222,678 | B2 | * | 5/2007 | Shim | 169/37 |
| 7,275,603 | B2 | | 10/2007 | Polan | |
| 7,562,715 | B2 | * | 7/2009 | Groos | 169/16 |
| 2,558,450 | A1 | | 6/2011 | Martin | |
| 2003/0201341 | A1 | | 10/2003 | Wancho et al. | |
| 2004/0055763 | A1 | * | 3/2004 | Petersen et al. | 169/37 |
| 2005/0178564 | A1 | | 8/2005 | Orr | |
| 2005/0224237 | A1 | * | 10/2005 | Groos | 169/37 |

FOREIGN PATENT DOCUMENTS

WO WO 02/15981 A1 2/2002

OTHER PUBLICATIONS

Model F4FR-NF Non-Ferrous Quick Response Concealed Automatic Sprinkler for MRI Type Applications; Reliable; Sep. 2006; Bulletin 002 Rev. C; pp. 1-2; The Reliable Automatic Sprinkler Co., Inc.; Elmsford, NY.

Model G4 Concealed Automatic Sprinkler; Reliable; Jun. 2002; Bulletin 121 Rev. I; pp. 1-2 The Reliable Automatic Sprinkler Co., Inc.; Mount Vernon, NY.

Model RFC43 (SIN RA0612); Model RFC49 (SIN RA0616) Flat Concealed Residential Sprinklers; Reliable; Dec. 2006; Bulletin 006 Rev. D; pp. 1-4 The Reliable Automatic Sprinkler Co., Inc.; Elmsford, NY.

Model RFC56 Concealed Residential Sprinkler; Reliable; Apr. 2005; Bulletin 009 Rev.A; pp. 1-4; The Reliable Automatic Sprinkler Co., Inc.; Mount Vernon, NY.

Residential Sprinklers for Sloped Ceilings; Apr. 2007; Bulletin 035 Rev.F; pp. 1-12; The Reliable Automatic Sprinkler Co., Inc.; Elmsford, NY.

Model G1 Concealed Automatic Sprinkler; Reliable; Apr. 2002; Bulletin 115 Rev. R; pp. 1-4; The Reliable Automatic Sprinkler Co., Inc.; Mount Vernon, NY.

Quick Response Concealed Horizontal Sidewall Sprinkler (available since 2001); Oct. 2007; Viking Technical Data; The Viking Corporation; Hastings MI; pp. 63a-63e (Replaces pp. 63a-63e, dated Mar. 2007).

Freedom Residential Concealed Pendent Sprinkler VK425 (K4.1); Mar. 2007; Viking Technical Data; The Viking Corporation; Hastings MI; pp. 147k-147o; (Replaces pp. 147a-147c, dated May 2005).

Freedom Residential Concealed Pendent Sprinkler VK456 (K4.9) (available since 2006); Jul. 2008; Viking Technical Data; The Viking Corporation; Hastings MI; pp. 147e-147j; (Replaces pp. 147e-147j, dated May 2008).

Underwriters Laboratories Inc. (UL), "UL 1626—UL Standard for Safety of Residential Sprinklers for Fire Protection Service", Oct. 2003, 69 pages.

National Fire Protection Association, NFPA 13D—Standard for the Installation of Sprinkler Systems in One- and Two-Family..Homes, 2002 Edition, 30 pages.

National Fire Protection Association, NFPA 13R—Standard for the Installation of Sprinkler Systems in Residential Occupancies..in Height, 2002 Edition, 27 pages.

National Fire Protection Association, NFPA 13—Standard for the Installation of Sprinkler Systems, 2002 Edition, 334 pages.

Tyco Fire & Building Products, Rapid Response, "Series LFII Residential Concealed Pendent Sprinklers, Flat Plate 4.9 K-factor", TFP 442, Jan. 2006, 4 pages.

Examination Report issued in related co-pending European Application No. 06 772 108.4-1258; Sep. 30, 2010; 5 pages.

First Examination Report issued in related co-pending New Zealand Application No. 563953; Aug. 27, 2009; 2 pages.

Second Examination Report issued in related co-pending New Zealand Application No. 563953; Nov. 29, 2010; 1 page.

First Office Action issued in related co-pending Chinese Appln. No. 200680027706.0. An English translation is attached; Nov. 23, 2010; 25 pages.

International Preliminary Report on Patentability issued in Intl. Appln. No. PCT/US2006/021682; Dec. 6, 2007; 6 pages.

The International Search Report, Mar. 2, 2007.

* cited by examiner

RESIDENTIAL FLAT PLATE CONCEALED SPRINKLER

PRIORITY DATA AND INCORPORATION BY REFERENCE

This application is a 371 of PCT/US2006/021682, filed Jun. 5, 2006, which claims priority to U.S. Provisional Patent Application Ser. No. 60/686,971, filed Jun. 3, 2005, the entireties of which are hereby incorporated by reference.

TECHNICAL FIELD

This invention relates generally to residential sprinklers, systems and methods of use. More specifically, the invention is directed to residential concealed flat plate sprinklers and their methods of use in residential sprinkler systems.

BACKGROUND OF THE INVENTION

Residential automatic fire protection sprinklers are typically designed to specific performance criteria or standard that has been accepted by industry. The performance criteria establishes the minimum performance standards for a given sprinkler to be consider sufficient for use as a residential fire protection product. For example, Underwriters Laboratories Inc. (UL) "Standard for Safety for Residential Sprinklers for Fire Protection Service" (October 2003) (hereinafter "UL 1626"), which is incorporated herein in its entirety be reference thereto, is believed to be an accepted industry standard.

The National Fire Protection Association (NFPA) also promulgates standards relating to residential fire protection such as, for example, (i) NFPA Standard 13 (2002) (hereinafter "NFPA 13"); (ii) NFPA Standard 13D (2002) (hereinafter "NFPA 13D); and (iii) NFPA Standard 13R (2002) (hereinafter "NFPA 13R") (collectively "NFPA Standards") each of which is incorporated in its entirety herein by reference thereto. In order for a residential sprinkler to be approved for installation under NFPA Standards, such sprinkler typically must pass various tests, for example, tests promulgated by UL under UL 1626, in order to be listed for use as a residential sprinkler. Specifically, UL 1626 generally requires a sprinkler, as described in Table 6.1 of Section 6, to deliver a minimum flow rate (gallons per minute or "gpm") for a specified coverage area (square feet or "$ft^2$") so as to provide for a desired average density of at least 0.05 gpm/$ft^2$. For instance, for a 16 ft.×16 ft. room size with a 256 $ft^2$ coverage area, a residential sprinkler that can provide the minimum density in an optimum manner would utilize a flow of water of thirteen gallons per minute (13 gpm). Thus, 13 gpm is the minimum flow listing for a coverage area of 256 $ft^2$. In addition to a sprinkler configuration providing the minimum density at the minimum flow listing, the sprinkler advantageously would achieve the minimum flow listing at the lowest possible pressure. The minimum flow rate tabulated in Table 6.1 can be used to calculate a predicted minimum fluid pressure needed to operate a sprinkler by virtue of a rated K-factor of the sprinkler. A rated K-factor of a sprinkler provides a coefficient of discharge of the flow passage of the sprinkler, is defined as follow:

$$K-\text{factor}=\frac{Q}{\sqrt{p}}$$

where Q is the flow rate in GPM and p is the pressure in pounds per square inch gauge. Thus, for a rated K-factor of 4.9 and a minimum flow rate of 13 gpm, the residual or calculated minimum pressure is seven pounds per square inch (7 psi.).

In order for a sprinkler to pass actual fluid distribution tests as described in Sections 26 and 27 of UL 1626 however, the actual minimum pressure of the test sprinkler may differ from the calculated or predicted minimum pressure, which can be calculated using the given minimum flow rate of Table 6.1 in UL 1626 and the rated K-factor of the sprinkler. Further, the actual minimum fluid flow rate to pass these distribution tests of UL 1626 for a specified coverage area may even be higher than the tabulated minimum flow rate given in Table 6.1 of UL 1626. Consequently, any attempt to provide for a listed sprinkler (i.e., an operational sprinkler suitable for the protection of a dwelling unit) cannot be predicted by applications of a known formula to known residential sprinklers.

In order to provide an aesthetically appealing configuration of a sprinkler for use in a residence, the sprinkler may be configured to use a flat plate to conceal the sprinkler itself until the sprinkler is actuated. This type of sprinkler is known as a residential flat plate concealed sprinklers. It is believed that known residential flat plate concealed sprinklers that are configured for use in a pendent manner range in K-factor from 4.1 to 5.6 (gpm/$psi^{1/2}$).

In order for a residential flat plate concealed sprinkler to operate, a two step operation occurs when a fire hazard is to be addressed. First, the cover of the concealed sprinkler must disengage from the sprinkler. Second, the sprinkler must operate to allow water to flow. Because of the two step operation of the residential flat plate concealed sprinkler, and that such residential sprinklers are typically fully recessed into a ceiling, residential flat plate concealed sprinklers have an increased flow rate above the minimum flow listings in order to successfully pass UL 1626 fire tests.

It is believe that known residential flat plate concealed sprinklers have been unable to successfully pass the UL 1626 test standard for a 16 ft.×16 ft. room size fire test at both the minimum flow rate (13 gpm) and the minimum operating pressure (7 psi). Furthermore, it is also believed that known residential flat plate concealed sprinklers have been unable to successfully achieve the minimum flow rates of seventeen gallons per minute (17 gpm.) for an 18 ft.×18 ft. room size and twenty gallons per minute for a 20 ft.×20 ft. room size in accordance with UL 1626.

DISCLOSURE OF INVENTION

A preferred embodiment of the present invention is believed to be the first residential automatic sprinkler with a flat plate that conceals the sprinkler to successfully complete UL 1626 distribution and fire testing with both minimum flow (13 gpm) and minimum pressure (7 psi) for an area as large as 16 ft.×16 ft. In addition, the sprinkler of the preferred embodiment is believe to be the first known sprinkler that has successfully completed distribution and fire tests in the 18 ft.×18 ft. and 20 ft.×20 ft. room sizes, with minimum flows of 17 gpm and 20 gpm respectively. More specifically, the sprinkler can provide a minimal flow of seventeen gallons per minute (17 gpm) in successful fluid distribution and fire tests for a 324 square feet area (18 ft.×18 ft.) at about twelve pounds per square inch (12 psi.), and further provide a minimal flow of twenty gallons per minute (20 gpm.) for a 400 square foot test area (20 ft.×20 ft.) at less than seventeen pounds per square inch and even more preferably at about 16.7 psi. The preferred embodiment utilizes a sprinkler with a nominal discharge coefficient (K Factor) of 4.9 gpm/psi$^{1/2}$. Through the specific combination of a deflector and a projection cone geometry, the preferred embodiment of the sprinkler has achieved the specified residential listings for both flow and pressure.

One preferred embodiment provides a residential flat plate concealed sprinkler for the fire protection of an area ranging from about 144 square feet to about 400 square feet. The sprinkler preferably includes an outer housing having an inner surface defining a chamber and a body at least partially disposed within the chamber. The body preferably has an inlet and an outlet spaced along a longitudinal axis, the outlet having a minimum design fluid flow ranging from about thirteen gallons per minute to about twenty gallons per minute (13-20 gpm) and the inlet having a minimum design input fluid pressure ranging from about seven pounds per square inch to about seventeen pounds per square inch (7-17 psi.). The body further preferably includes an inner surface defining a passageway for communication between the inlet and the outlet. The at least one guide member has a proximal end and a distal end. The proximal end is preferably coupled to the body and the distal end having telescopic relative movement relative to the outlet in direction parallel to the longitudinal axis. The sprinkler further preferably includes a deflector plate assembly for distributing a flow of fluid over the protected area. The deflector assembly is preferably coupled to the distal end of the at least one guide member so that the deflector has a first position distal of the outlet and a second position distal of the first position. The deflector assembly includes a plate member and a projection member coupled to the plate member to define a proximal surface substantially orthogonal to the longitudinal axis and spaced axially from the outlet and a distal surface distal of the proximal surface and orthogonal to the longitudinal axis. The distal surface preferably defines an oblong perimeter circumscribed about the longitudinal axis and further including a plurality of slots substantially equiradially spaced about the longitudinal axis. Each slot has a substantially straight portion initiating from the perimeter and extending radially toward the longitudinal axis to define a slot length and further having a slot width. The plurality of slots also further defines a first slot group having a first slot length and at least a second slot group having a second slot length smaller than the first slot length.

In another preferred embodiment, provided is a pendant concealed sprinkler that includes an outer housing and an inner housing coaxially aligned along a longitudinal axis. The sprinkler further includes a body having at least a portion disposed in the inner and outer housing. The body preferably has an inner surface defining a passageway including an inlet and an outlet spaced apart along the longitudinal axis and defining a K-factor of about 5. The sprinkler further preferably includes a closure assembly to occlude the outlet and a thermally responsive trigger element having a first state aligned with the longitudinal axis to support the closure assembly adjacent the outlet and a second state to displace the closure assembly from the outlet. The sprinkler further preferably provides a deflector assembly distal of the outlet. The deflector assembly preferably has a plurality of deflecting surfaces substantially perpendicular to the longitudinal axis and a plurality of slots in at least one of the deflecting surfaces to provide a distribution of a fluid over a protection area a protection area ranging from about 144 square feet to about 400 square feet, the fluid distribution having a density of at least 0.05 gallons per minute per square foot (0.05 gpm/ft$^2$) for a minimum operating pressure and a minimum operating fluid flow corresponding to the protection areas. The minimum operating pressures range from about seven pounds per square inch to about seventeen pounds per square inch (7-17 psi.) and the range of minimum operating fluid flows ranging from about thirteen gallons per minute to about twenty gallons per minute (13-20 gpm). The preferred sprinkler further includes a plate assembly having a cover plate and a thermally responsive fastener coupling the plate assembly to the outer housing such that the cover plate engages the deflector assembly and contains the deflector assembly within the outer housing.

In yet another preferred embodiment, a sprinkler preferably includes a body having an inner surface defining a passageway for carrying a fluid. The passageway includes an inlet and an outlet spaced apart along the longitudinal axis and defines a K-factor of about 5. The sprinkler also includes a closure assembly adjacent the outlet to occlude the outlet and a thermally responsive support means for maintaining the closure assembly adjacent the outlet. The preferred sprinkler also provides means for distributing a flow of fluid over a protection area ranging from about 144 square feet to about 400 square feet, the fluid distribution having a density of at least 0.05 gallons per minute per square foot (0.05 gpm/ft$^2$) so as to define a range of minimum operating pressures ranging from about seven pounds per square inch to about seventeen pounds per square inch (7-17 psi.) and a range of minimum operating fluid flows ranging from about thirteen gallons per minute to about twenty gallons per minute (13-20 gpm). In addition, the sprinkler preferably includes a thermally responsive plate means for maintaining a minimum spacing between the outlet and the means for distributing.

Another embodiment according to the present invention provides a method of fire protecting an area with a sprinkler having a coverage area no greater than 256 square feet. The coverage area is preferably about 256 square feet and further be about 196 square feet or further in the alternative be about 144 square feet. The method includes discharging a fire fighting fluid at a flow rate of about thirteen gallons per minute (13 gpm) from a sprinkler body having a K-factor of about 5 and more preferably about 4.9. The method also includes distributing the fluid over the area at a fluid design density of about 0.05 gallons per minute per square foot (0.05 gpm/ft$^2$). The method also preferably The method includes introducing the fluid to the body at an operating pressure of about seven pounds per square inch (7 psi.).

Another preferred embodiment provides a method of fire protecting an area with a sprinkler having a coverage area measuring greater than 256 square feet but no greater than 324 square feet. The method preferably includes discharging a fire fighting fluid at a flow rate of about seventeen gallons per minute (17 gpm) from a sprinkler body having a K-factor of about 5 and further distributing the fluid over the area at a fluid design density of at least 0.05 gallons per minute per square foot (0.05 gpm/ft$^2$). Preferably the fluid is introduced to the sprinkler at an operating pressure of about twelve pounds per square inch (12 psi.).

In yet another alternative embodiment of the method, a method is provided for protecting an area having a sprinkler coverage area measuring greater than 324 square feet but no greater than 400 square feet. The method includes discharging a fire fighting fluid at a flow rate of about twenty gallons per minute (20 gpm) from a sprinkler body having a K-factor of about 5 and distributing the fluid over the area at a fluid design density of at least 0.05 gallons per minute per square foot (0.05 gpm/ft$^2$). Preferably, the fluid is introduced to the body at an operating pressure of about seventeen pounds per square inch (17 psi.) and more preferably about 16.7 psi.

In yet another embodiment of any of the above described methods, distributing the discharged fluid includes distributing the fluid as per Section 26 of UL 1626 and applying the fluid over the coverage area such that the rate of application is at least 0.02 gallons per minute per square foot (0.02 gpm/ft$^2$), wherein no more than four areas measuring one square foot have an application rate of at least 0.015 gallons per minute per square foot (0.05 gpm/ft$^2$). Any of the above methods can further define a minimum sprinkler to sprinkler spacing of about eight feet (8 ft.).

Another preferred aspect of the present invention provides a residential sprinkler system that preferably includes a fluid supply source, a maximum coverage area in a residential dwelling, the coverage area being no greater than 256 square feet; and a residential sprinkler having a body with an inlet and an outlet and a K-factor rating of about 5 and more preferably about 4.9. The sprinkler is preferably coupled to the fluid supply source such that the supply provides a minimum operating pressure to the inlet at about seven pounds per square inch (7 psi.) and the outlet provides a discharge flow having a flow rate of about thirteen gallons per minute. The sprinkler preferably includes a deflector assembly to deflect the discharge flow and define a distribution pattern providing a fluid density over the coverage area of about 0.05 gallons per minute per square foot (0.05 gpm/ft$^2$).

In yet another embodiment of the system preferably includes a maximum coverage area in a residential dwelling being greater than 256 square feet and less than about 324 square feet. The preferred system further includes a residential sprinkler having a body with an inlet and an outlet and a K-factor rating of about 5. The sprinkler being coupled to the fluid supply source such that the supply provides a minimum operating pressure to the inlet of about twelve pounds per square inch (12 psi), and the outlet provides a discharge flow having a flow rate of about seventeen gallons per minute (17 gpm).

In another alternative embodiment of the system, the maximum coverage area is preferably greater than about 324 square feet and less than about 400 square feet. The system further preferably includes at least one residential sprinkler having a body with an inlet and an outlet and a K-factor rating of about 5. The sprinkler is preferably coupled to the fluid supply source such that the supply provides a minimum operating pressure to the inlet of about seventeen pounds per square inch (17 psi), and the outlet provides a discharge flow having a flow rate of about twenty gallons per minute (20 gpm). The sprinkler includes a deflector assembly to deflect the discharge flow and define a distribution pattern the pattern providing a fluid density over the coverage area of at least 0.05 gallons per minute per square foot (0.05 gpm/ft$^2$).

BRIEF DESCRIPTIONS OF THE DRAWINGS

The accompanying drawings, which are incorporated herein and constitute part of this specification, illustrate exemplary embodiments of the invention, and, together with the general description given above and the detailed description given below, serve to explain the features of the invention.

MODE(S) FOR CARRYING OUT THE INVENTION

Figure 1:
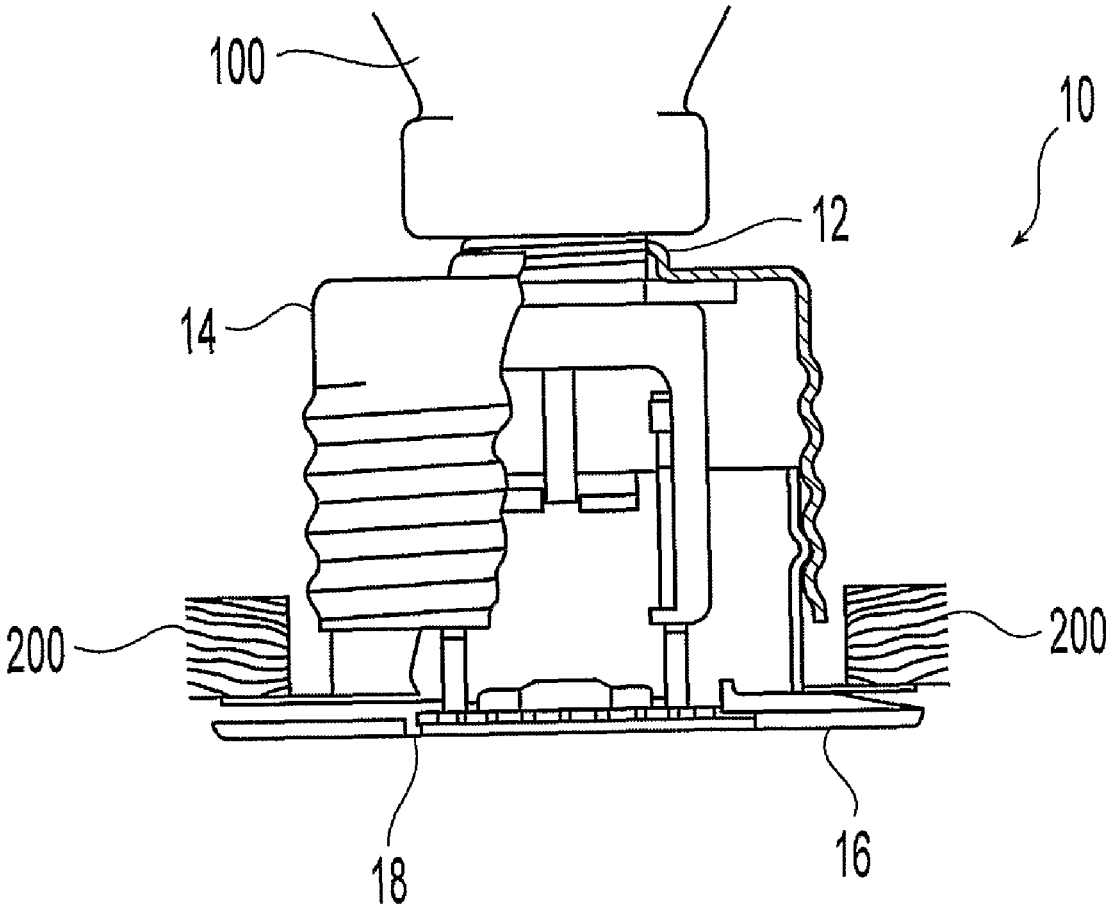
FIG. 1 shows a cut-away view of a preferred residential flat plate concealed sprinkler.
Figure 2:
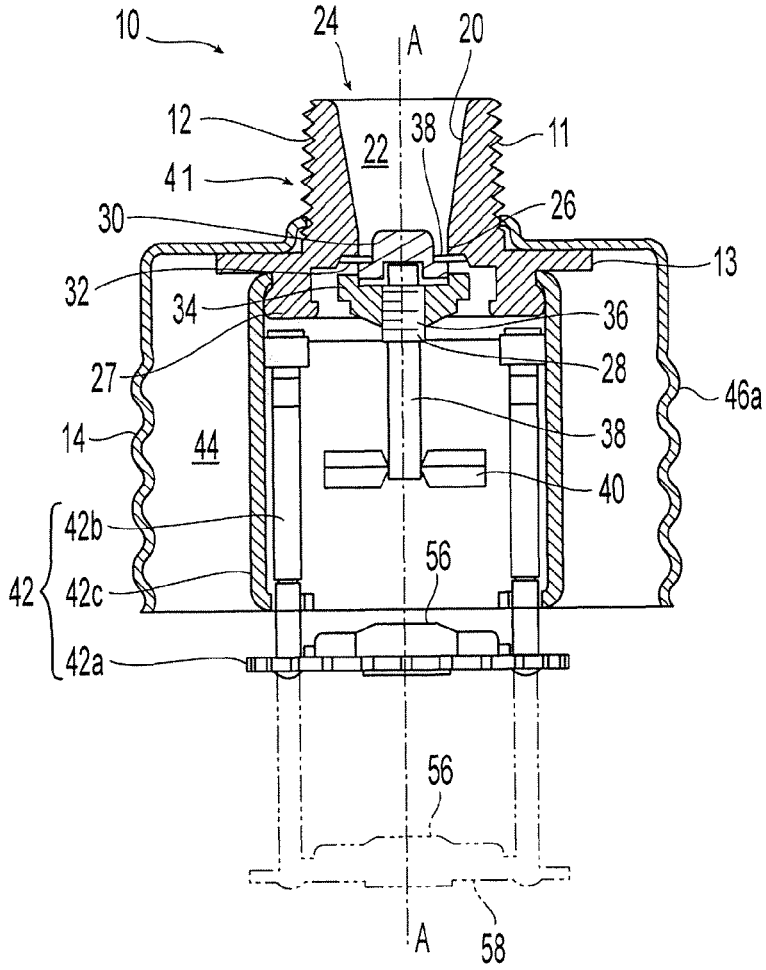
FIG. 2 is a cross-sectional view of the sprinkler of FIG. 1.

Shown in FIGS. 1-2 is an illustrative embodiment of a concealed pendant residential fire sprinkler 10 that can be used in residential applications, for example, to protect a floor area of a compartment in the residential dwelling unit. As used herein, the term "residential" is a "dwelling unit" as defined in the 2002 Edition of NFPA 13D and NFPA 13R, which can include commercial dwelling units (e.g., rental apartments, lodging and rooming houses, board and care facilities, hospitals, motels or hotels) to indicate one or more rooms, arranged for the use of individuals living together, as in a single housekeeping unit, that normally have cooking, living, sanitary, and sleeping facilities. The residential dwelling unit normally includes a plurality of compartments as defined in the NFPA Standards, where generally each compartment is a space that is enclosed by walls and ceiling. Accordingly, the sprinkler 10 can be configured for use in a residential sprinkler system, preferably a wet pipe residential sprinkler system for: (i) one and two family dwellings and mobile homes per NFPA 13D; (ii) residential occupancies up to and including four stories in height per NFPA 13R; or (iii) any other occupancy as per NFPA 13.

Referring to FIG. 1, a partially cut-away view of a preferred embodiment of the residential sprinkler 10 is shown coupled to a sprinkler system, preferably a wet sprinkler system 100, in a plenum space above a ceiling 200 of a known construction such as, for example, gypsum wallboard or ceiling tile. The sprinkler 10 preferably includes a body 12 configured to couple the sprinkler 10 to the sprinkler system 100. Preferably, the sprinkler 10 is coupled to a branch line of the sprinkler system 100 by way of a threaded connection between the body 12 and a corresponding fitting on a branch line of the sprinkler system 100. Alternative connections are possible provided the connection facilitates fluid communication between the sprinkler system 100 and the sprinkler 10 in a manner described herein below.

The sprinkler 10 preferably includes a support cup or outer housing 14 disposed about the body 12. The outer housing 14 provides a chamber for housing the sprinkler operational components such as, for example, the trigger and deflector assemblies. Connected below the housing 14 is a detachable cover plate assembly 16 providing means to conceal the sprinkler components from view beneath the ceiling 200. The cover plate assembly 16 preferably includes a substantially flat plate 18 that presents a low profile with respect to the ceiling 200. The plate 18 can include decorative or textured surface treatment or coloring so as to aesthetically blend in or coordinate with the surrounding environment. In operation, a portion of the plate assembly 16 is configured to separate from the outer housing 12 and/or the operational components of the sprinkler 10 thereby allowing the sprinkler 10 to actuate and discharge a fire fighting fluid over the area beneath the ceiling 200.

A cross-sectional view of the sprinkler 10 is provided in FIG. 2. The body 12 is shown with the preferred outer thread 11 for coupling to the sprinkler system 100 and further preferably including a multi-flat area 13 for engagement with an installation tool such as, for example, a socket-type wrench (not shown). The multi-flat area 13 can include, for example, six contiguous flat sides to form a hexagon shaped outer perimeter to the body 12 about which the installation tool can grip to thread the sprinkler 10 into or out of the sprinkler system 100.

The sprinkler 10 is preferably embodied as a concealed sprinkler. Accordingly, preferably threadedly engaged with the outer threads 11 of the body 12 is the outer housing 14. The outer housing 14 preferably includes an interior peripheral edge defining a centralized bore 41. The body 12 can be disposed through the central bore 41 and the interior peripheral edge of the outer housing 14 can engage the outer threads 11 of the body 12 to couple the body and the housing to one another. The multi-flat portion 13 of the body 12 can be dimensioned so as to form a stop that engages an inner surface of the outer housing 14 to limit the axial engagement of the body 12 through the central bore 42 of the outer housing 14.

The inner surface of the outer housing 14 is preferably radially spaced from the longitudinal axis A-A to define a chamber 44 for preferably surrounding and housing the operational components of the sprinkler 10. The inner surface of the housing 14 can include a coupling mechanism 46 for coupling to the cover plate assembly 16. Preferably, the housing 14 includes a rolled thread 46*a* along the inner surface for engagement with a portion of the plate assembly 16 to couple the elements together.

Figure 3:
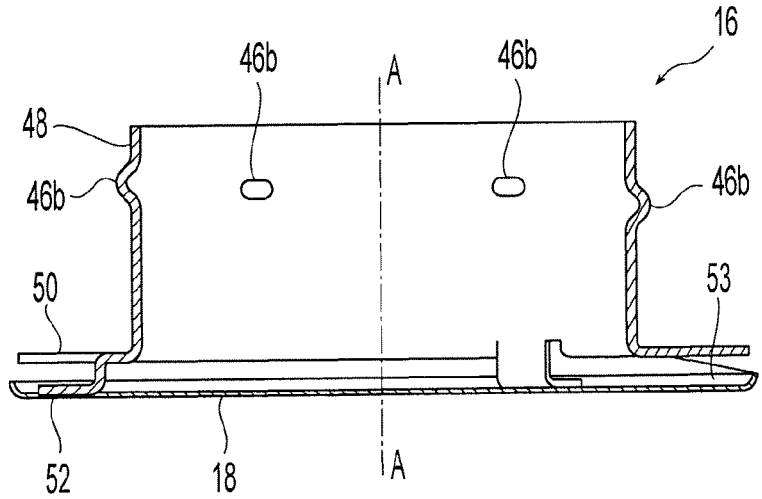
FIG. 3 is a preferred plate assembly of the sprinkler of FIG. 1.

Shown in FIG. 3 is a cross-sectional view of the preferably detachable plate assembly 16. The cover plate assembly 16 preferably includes a retaining sleeve portion 48 having a plurality of projections 46B for threaded engagement with the interior thread 46A of the outer housing 14 to couple the plate assembly 16 and outer housing 14A together. Alternatively, retaining sleeve portion 48 can include a threaded portion for mutual engagement with the interior thread 46*a* of the outer housing 14. The sleeve preferably includes a mounting surface 50 for engaging the surface of the ceiling 200 thereby limiting the axial engagement of the plate assembly 16 with the outer housing 14.

A cover plate member is attached to the retaining sleeve 48 such that it substantially conceals the chamber of the outer housing 14 thereby concealing the operational components of the sprinkler 10 such as, for example, the deflector assembly 42 as seen in FIG. 2. The cover plate member is preferably attached to the retaining sleeve by a thermally responsive coupling 52 such as, for example, a tab or beading of solder 52, which is rated to hold the plate member to the retaining sleeve 48 up to a desired temperature. Above the threshold temperature, the solder 52 melts releasing the cover plate member and exposing the operational elements of the sprinkler 10 to address the heat source. The solder 52 is preferably rated between 115° F. to about 140° F. and more preferably from about 117° F. to about 137° F. and is even more preferably about 135° F. More preferably, three tabs of solder 52 are applied radially about the longitudinal axis. To facilitate the separation of the cover plate member and the retaining sleeve 48, the plate assembly 16 further preferably includes an ejection spring 53 which biases the cover plate member away from the retaining sleeve 48. The ejection spring 53 can be, for example, a compression spring member disposed between the deflector assembly 42 and the plate member 18. As described above, the cover plate member is preferably a substantially flat plate 18 to provide a low profile relative to the ceiling 200. Alternatively, the cover plate member 18 can include a step or curved profile so as to present, for example, a concave surface relative to the view below the ceiling 200.

The operational components of the sprinkler 10 can individually and collectively define sprinkler performance, i.e. water distribution and compliance with known sprinkler standards such as, for example, the October 2003 edition of UL 1626. More preferably, the operational components of the sprinkler 10 provide for a heat sensitivity or thermal responsiveness along with water distribution characteristics that can effectively address a residential fire and thereby improve the chance for occupant to escape or be evacuated. The body 12 is an operational component having, as seen in FIG. 2, an inner surface 20 defining a passageway or conduit 22. The passageway 22 provides communication between a body inlet 24 and a body outlet 26 spaced apart along the sprinkler longitudinal axis A-A. The inlet 24 is configured to receive fluid from the sprinkler system 100 and the outlet 26 is configured to discharge the fluid for distribution over a protection area beneath the sprinkler 10. The body 12 is preferably configured to define a discharge coefficient or K-factor of about 5 and more preferably at least 4.9. The K-factor relates in part to the shape of the passageway 22 and other dimensions of the passageway 22, inlet 24 and/or outlet 26. As used herein, a discharge coefficient or K-factor of the sprinkler 10 is quantified or rated as a flow of water Q out of the passageway 22 of the body 12 of the sprinkler 10 in gallons per minute (gpm.) divided by the square root of the pressure p of water fed into body 12 in pounds per square inch gauge (psig), where $K=Q/(p)^{1/2}$.

The sprinkler 10 is shown, in-part, in a non-actuated state, i.e., the outlet 26 is closed off by a closure assembly 28. The closure assembly 28 is preferably disposed adjacent the outlet 26 to occlude the passage way 22 thereby preventing discharge of fluid from the outlet. The closure assembly 28 preferably includes a plug 30 coupled to a washer 32 having a perimeter contiguous to the inner surface 20 of the body 12 forming the outlet 26. The washer 32 is preferably a Bellville type, Beryllium Nickel washer with a Teflon® coating, of about 0.02 inches. The plug 30 is preferably coupled to a seat member 34 by a compression screw or other fastener 36.

The closure assembly further includes a thermally responsive trigger assembly or lever 38 providing means for controlling displacement of the washer 32 from the outlet 26 to operate the sprinkler 10. More specifically, the lever 38 is preferably a fusible link assembly having two link halves held together by a solder link element 40 thereby maintaining the sprinkler 10 in a non-actuated state. When exposed to a sufficient level of heat, the solder element melts and the two link halves separate from one another so as to displace the closure assembly, operating the sprinkler 10 and permitting discharge of fluid from the outlet 26. Alternative closure assemblies 28 and thermal triggers 38 can be provided so long as the alternative construction adequately occludes the passageway 22 when the sprinkler is in an non-actuated state and is adequately thermally responsive to actuate the sprinkler when needed. The trigger assembly 38 is preferably configured such that the sprinkler 10 has a temperature rating of ranging from about 135° F. to about 170° and more preferably is about 160° F. A higher sprinkler temperature rating can provide additional flexibility in sprinkler selection over a range of installation configurations and system designs.

Distal of the outlet 26 is the deflector assembly 42 providing means for distributing a fluid discharge from the outlet 26 over an area below the outlet. The deflector assembly 42 preferably includes a deflector plate assembly 42*a*, one or more guide members 42*b* and an inner or guide member housing 42*c* disposed about a distal portion of the body 12. In FIG. 2, the deflector assembly 42 is shown in both its non-deployed state (solid lines) and its deployed state (dashed lines). More specifically, the deflector assembly 42 has a first retracted position distal of the sprinkler outlet 26 and a second deployed position distal of the first position. Preferably, the plate 18 supports the deflector assembly 42 in its first position so as to locate at least the deflector plate assembly 42*a* at a minimum distance from the outlet 26.

In one preferred embodiment, the inner housing 42*c* is disposed about a flange at the distal end 27 of body 12. The inner housing 42*c* preferably extends coaxially within the outer housing 14. The inner housing 42*c* includes an interior surface at least partially circumscribed about the longitudinal axis and to which one or more guide members 42*b* are secured. Preferably, the deflector assembly 42 includes a pair of elongated guide members 42*b* spaced parallel from one another about and extending distally along the direction of the longitudinal axis A-A preferably interior to the inner housing 42*c*. Each of the guide members 42*b* preferably includes a proximal end coupled to a portion of the interior of the inner housing 42*c*. Coupled to the distal ends of the guide members 42*b* is the deflector plate assembly 42*a*, thereby locating the deflector plate assembly 42*a* in a first position distal of the outlet 26. The guide members 42*b* are preferably telescoping members relative to the inner housing 42*c*, thus permitting the deflector plate assembly 42*a* to extend distally from the first position to a second position distal of the first.

The deflector plate assembly 42*a* is shown, in-part, in dashed line corresponding to the second or deployed position. In this preferred operational position, the deflector plate assembly 42*a* presents an upper surface 56 and an opposite lower surface 58, each substantially orthogonal to the longitudinal axis A-A for distributing a fluid discharge from the outlet 26. In particular, the upper surface 56 provides a distribution surface for distributing a minimum flow rate discharged from the outlet 26.

Operation of the sprinkler 10 provides that, upon exposure to a heat source, such as a fire, generating sufficient heat to melt the solder tabs 52, the plate 18 falls away from the retaining sleeve 48. The deflector assembly 42 then drops from its first or non-deployed position to a second or deployed position. The solder holding the fusible link 38 melts under the exposure to the increasing heat, the halves separate to actuate the sprinkler and displace the closure assembly. Upon displacement of the closure assembly, fluid discharges from the outlet 26 over the protection area.

Figure 7A:
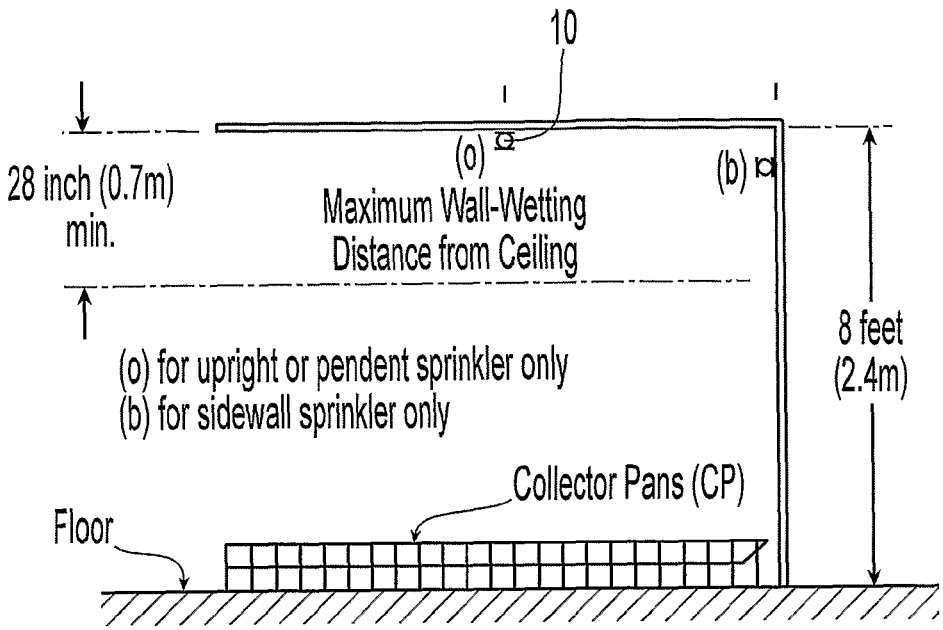
FIGS. 7A-7C are schematic views of a fluid distribution test area as per UL 1626.
Figure 7B:
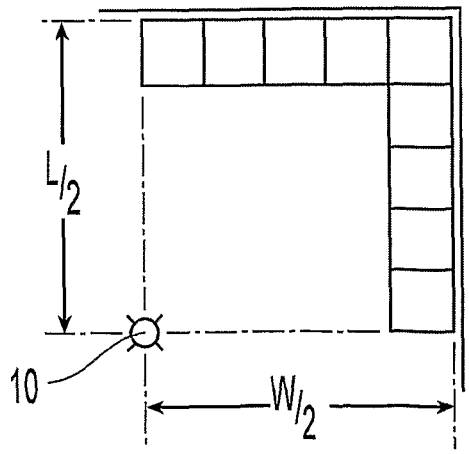
Figure 7C:
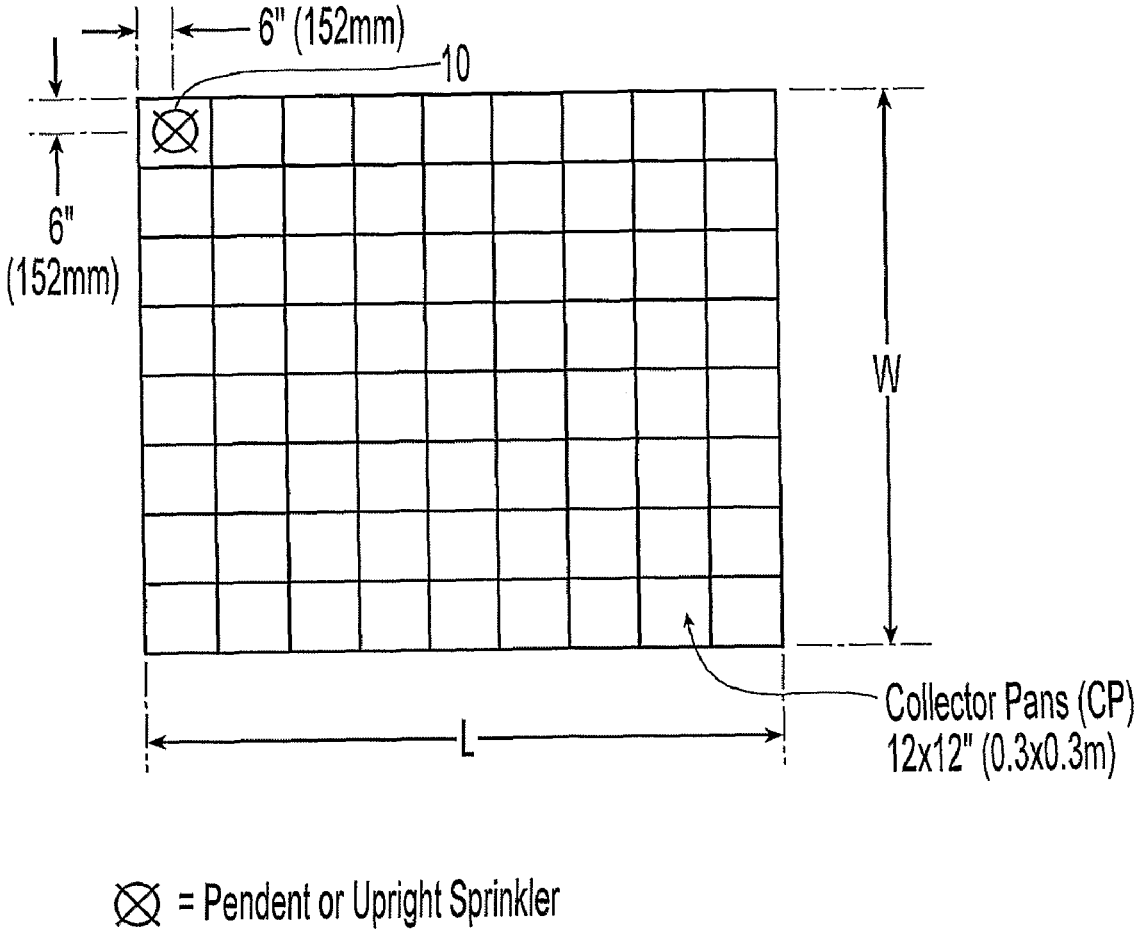

Accordingly, the sprinkler 10 can be tested in accordance with UL 1626, Section 26 to identify an acceptable minimum operational flow rate of discharge from the sprinkler 10 capable of distributing a flow of fluid over a horizontal surface in a rectangular test area such as, for example schematically shown in FIG. 7C, such that the application rate or density for any one square foot area (1 $ft.^2$) within the test area shall be at least 0.02 gallons per minute per square foot provided that no more that four-one square foot areas (4×1 $ft^2$) in any given quadrant of the test area is at least 0.015 gallons per minute per square foot. More preferably, a preferred embodiment of the sprinkler 10 can be satisfactorily tested in accordance with UL 1626 so as to identify a minimum operational flow rate of thirteen gallons per minute (13 gpm) that results in a fluid distribution over a 256 square foot area (16 ft.×16 ft.) having a density of 0.05 gallons per minute per square foot (0.05 $gpm/ft^2$). Even more preferably, the test is conducted so as to identify an actual minimum operating pressure for the preferred sprinkler 10, having a nominal K-factor of 4.9 and a minimum operational flow of thirteen gallons per minute (13 gpm) capable of producing a fluid distribution over a 256 square foot test area (16 ft.×16 ft.) at a density of 0.05 gallons per minute per square foot (0.05 $gpm/ft^2$), to be about seven pounds per square inch (7 psi.). Moreover, the preferred embodiment of the sprinkler 10 further provides for the minimal flow of seventeen gallons per minute (17 gpm) in successful fluid distribution tests for a 324 square feet area (18 ft.×18 ft.), and a minimal flow of twenty gallons per minute (20 gpm.) for a 400 square foot test area (20 ft.×20 ft.).

In addition, the sprinkler 10 can be tested in accordance with UL 1626, Section 27 to identify an acceptable level of fluid distribution from the sprinkler 10 capable of distributing a flow of fluid over a vertical surface in a rectangular test area such as, for example schematically shown in FIGS. 7A and 7B, such that walls within the test coverage area are wetted within twenty-eight inches (28 in.) of the ceiling with the sprinkler 10 discharging water in a uniform manner at a specified design flow rate. In a square coverage or test area each wall within the coverage area shall be wetted with at least five percent (5%) of the sprinkler flow. For rectangular coverage or test areas, each wall within the coverage area shall be wetted within a proportional water amount based on twenty percent (20%) of the total sprinkler discharge in accordance with the following formula:

$$WW=20\%(D/P)$$

where:

WW=Required amount of water collected on a wall in percent

D=Wall length (ft.) and

P=Total perimeter of coverage area (ft.)

It is believed that the various features of the sprinkler 10 and its operational components allow for compliance with UL 1626 at the minimal flow and pressures described above. The deflector plate assembly 42*a* and the upper surface 56 preferably includes or defines one or more of surfaces substantially orthogonal to the longitudinal axis. More preferably, the deflector plate assembly 42*a* includes, as seen for example in FIG. 4B, a first centralized surface 43 spaced axially from the outlet 26, a second surface 45 preferably circumscribing the first surface 43 and spaced distally from the first surface 43. Even more preferably, the deflector plate assembly 42*a* includes a third surface 47 circumscribing the first and second surfaces 43, 45 and spaced distally from the second surface 45. The plurality of surfaces 43, 45, 47 provide a surface over which fluid discharged from outlet 26 can impact, deflect and flow for distribution beneath the sprinkler 10.

Figure 4A:
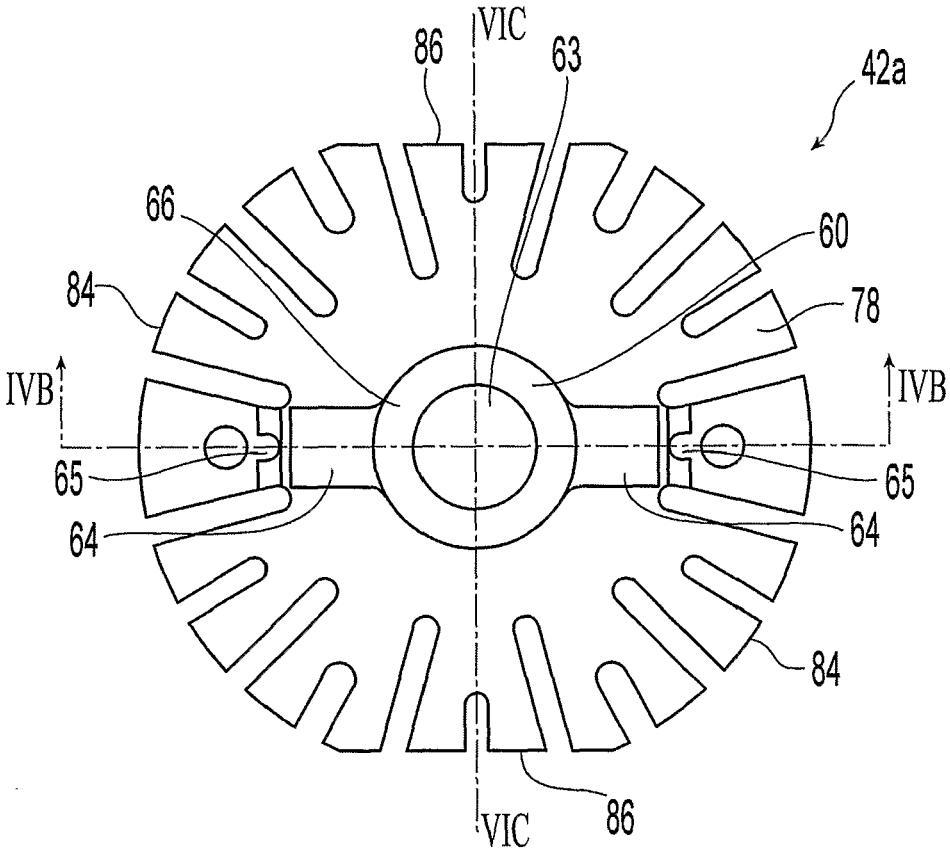
FIG. 4A is a plan view of a preferred deflector plate assembly of the sprinkler of FIG. 1
Figure 4B:
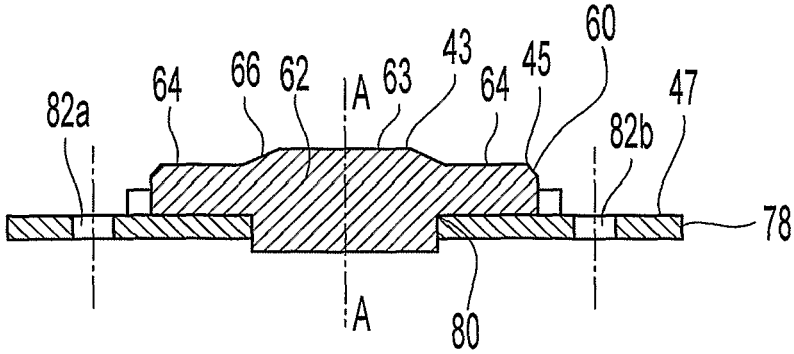
FIG. 4B is a cross-sectional view of the deflector plate assembly cut along line IVB-IVB of FIG. 4A.
Figure 5A:
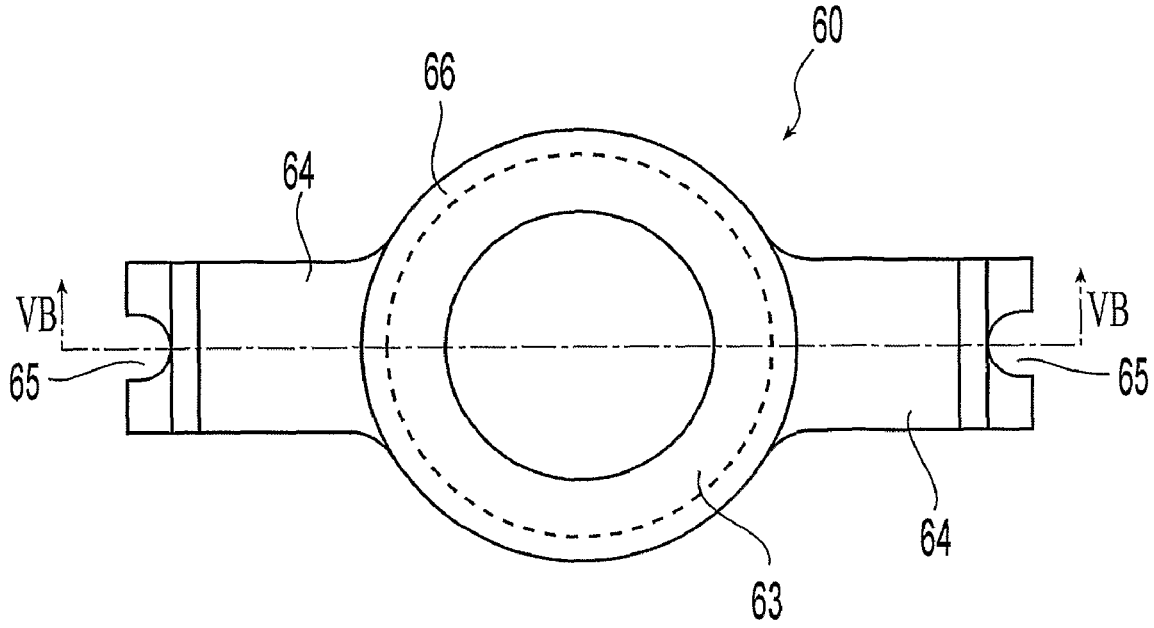
FIG. 5A is a preferred projection member in the deflector plate assembly of FIG. 4A.
Figure 5B:
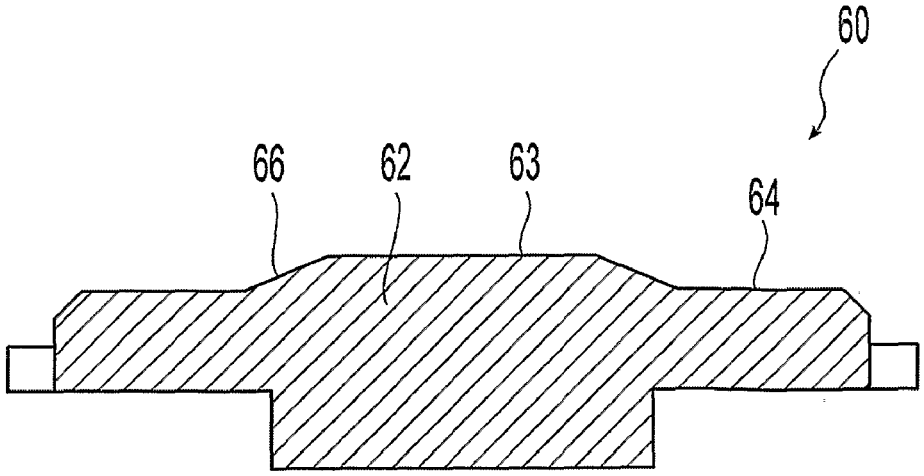
FIG. 5B is a cross-sectional view of the projection member along line VB-VB of FIG. 5A.

One preferred embodiment of the deflector plate assembly 42*a*, as seen in FIGS. 4A and 4B preferably includes the substantially flat plate member 78 and a projection member 60. The flat plate member 78 and projection member 60 preferably collectively form the upper surface 56 and lower surface 58 of the deflector plate assembly 42*a* to distribute the flow of fluid from the outlet 26. For example, water discharged from the outlet 26 deflects off the surfaces of the flat plate member 78 and the projection member 60 to deflect the water axially and radially to further impact other elements of the sprinkler 10 such as the inner surface of the outer housing 14, the inner housing 42*c* and/or the guide members 42*b* so as to provide a sprinkler performance and water distribution characteristic acceptable under UL 1626.

The projection member 60 is preferably centrally located with respect to the plate member 78 and aligned with the longitudinal axis A-A. As seen in FIGS. 4A, 4B, the projection member 60 has a central core 62 having preferably a substantially planar proximal tip 63 and axially extending therefrom a substantially cylindrical body. The projection member 60 can include a member 64 extending radially from the core 62. More preferably, diametrically disposed about the core 62 are radially extending members 64. Alternatively, a plurality extending members can be radially disposed about the core 62 or further in the alternative, an enlarged flange can be circumscribed about the central core 62. The projection member 60 preferably includes an oblique or angled surface 66 extending contiguously from the core 62 to the radially extending members 64. The surface 66 can define an angle ranging from about twenty to thirty degrees (20°-30°) relative to the substantially planar surface and is more preferably about twenty-three degrees (23°) relative to the substantially planar surface. More preferably the projection member 60 is of integral or unitary construction in which the angled surface 66 is circumscribed about the longitudinal axis so as to define a substantially frusto-conical plane and further define a projection cone geometry. The planar tip 63 and radially extending members 64 respectively and preferably provide the first central surface 43 and the second surface 45 as described above.

The central core 62 of the projection member 60 is preferably engaged with the plate member 78. More preferably, the plate member 78 preferably includes a central bore 80 disposed about the substantially cylindrical body of the core 62. The plate member 78 preferably includes at least two lateral bores 82*a* and 82*b* disposed about the central bore 80. More preferably, the lateral bores 82*a* and 82*b* are aligned with and laterally spaced outside the radially extending members 64 as more clearly seen in FIG. 4A. The lateral bores 82*a*, 82*b* are preferably engaged or coupled to the preferred parallel guide members 42*b* so as to centrally locate the deflector plate assembly 42*a* along the longitudinal axis A-A distal of the outlet 26 as seen in FIG. 2. More specifically, the guide members 42*b* can include pin elements preferably fixedly disposed within the lateral bores 82*a*, 82*b*. The radially extending members 64 and the adjacent pin elements of the guide members 42*b* preferably provides a fluid flow surface or channel therebetween to distribute a fluid flow toward the flow distributing features of the plate member 78. The flow channels can provide for successful flow collection and wall wetting during UL 1626 testing. Referring again to FIG. 4A, the radially extending members 64 can include a void 65 defined at its lateral end adjacent to the guide member 42*c* through which a fluid discharge can flow.

The plate member 78 is preferably substantially oblong or oval in shape, preferably substantially disposed in a plane substantially perpendicular to the longitudinal axis A-A and defined by orthogonal plate axes IVB-IVB and VIC-VIC, as seen in the plan view of FIG. 4A. More specifically, the plate member 78 has a perimeter defining at least one arcuate edge 84 and one substantially straight edge 86. Preferably, the plate member 78 has a perimeter defining two diametrically opposed arcuate edges 84 intersecting the major plate axis IVB-IVB and two substantially parallel straight edges 86 opposed about the major plate axis IVB-IVB and orthogonal to the minor plate axis VIC-VIC. Preferably, the maximum spacing between the two parallel straight edges 86 along the minor axis VIC-VIC ranges from about 1.1 inches to about 1.5 inches and is preferably about 1.25 inches.

In one preferred embodiment of the plate member 78, a point along the defined arcuate edge 84 can further define a circle circumscribed about the longitudinal axis A-A. The defined straight edges 86 of the plate member 78 each further preferably define a chord length of the circle. Accordingly, the plate diameter defined by diametrically opposed points along arcuate edges 84 and merger axis IVB-IVB preferably ranges from about 1.25 inches to about 1.5 inches and is more preferably about 1.35 inches. Alternatively, the diameter defined by the plate member 78 can be a function of sprinkler height such the plate diameter to sprinkler height ratio ranges from about 0.5 to about 0.75 and is preferably about 0.70.

A preferred plate member 78 is shown in FIGS. 6A-6D without the projection member 60 engaged therewith. The plate member 78 includes an upper surface 78*a* and lower surface 78*b* each preferably parallel to the plane defined by the intersection of the major axis IVB-IVB and the minor axis VIC-VIC. More preferably, at least one of the upper and lower surfaces 78*a*, 78*b* has an angled portion, as seen for example in FIGS. 6C and 6D, that is angled at an angle $\alpha$ relative to the plane defined by the intersection of the major axis IVB-IVB and the minor axis VIC-VIC. The angle $\alpha$ can range from about five degrees to about ten degrees (5°-10°) and is more preferably about six degrees (6°). The angle $\alpha$ is preferably such that the lower surface is generally concave relative to the view from below the ceiling 200. More preferably, the angled portion is disposed at the outer perimeter of the plate member 78 thereby providing the plate member 78 with an angled lip. Even more preferably, the angle $\alpha$ of the upper surface 78*a* or the lower surface 78*b* is provided for only a portion of the plate member 78, for example, a radial span of about sixty degrees centered about the minor axis VIC-VIC. More specifically, the angled portion is preferably limited to the surface of the plate defining the diametrically opposed straight edges 86. Thus preferably, two angled portions of the plate member 78 are diametrically spaced apart about the major axis IVB-IVB, and more preferably define bend lines 79*a* and 79*b*. The bend lines 79*a* and 79*b* are preferably diametrically spaced at about one inch from one another, or more alternatively are spaced at length equivalent to about eight-three percent (83%) of the straight edge to straight edge width.

The angled portions of the plate member 78 are preferably configured to provide compliance with the wall wetting requirements Section 27 of UL and 1626. Moreover of the angled portions of the plate member 78 are preferably configured to minimize water spray overthrow and thus provide compliance with operation cold-soldering test of Section 22 of UL 1626 where a first preferred sprinkler 10 is actuated adjacent to a unactuated second preferred sprinkler 10 located at about 8 feet from the actuated sprinkler 10. Specifically, the straight edges 86 of the plate member 78 of the first sprinkler 10 can be spaced parallel the straight edge 86 in the plate member 78 of the second sprinkler 10. To satisfy the requirements of the test, while the first sprinkler 10 is discharging fluid at 100 psig or more, the first sprinkler 10 cannot prevent the actuation of the second sprinkler 10 as the second sprinkler is being exposed to heat and flame, as provided for in Subsection 22.2 of UL 1626. At approximately 100 psig or greater, it is believed that the fluid flowing radially along the surfaces of the plate member 78 has sufficient velocity to produce a downward flow separation at the angled portion of the plate member 78 and straight edges 86. Although the plate member 78 is preferably shown with the straight edges 86 and angular portion, any surface irregularity, geometry or treatment can be incorporated into the plate member 78 provided the surface irregularity can cause flow separation at fluid pressure of 100 psig or greater so as to prevent wetting of adjacent sprinklers located 8 or more feet in the directions of the plane defined by the A-A and IVB-IVB axes without the diminishing the effectiveness of the fluid distribution pattern provided by the deflector assembly 42. Accordingly, the sprinkler 10 provides for a minimum sprinkler spacing of about eight feet. Maximum spacing between adjacent sprinkler is preferably equivalent to the length of the coverage area being covered by the sprinkler. Accordingly, where the sprinkler 10 is configured for a coverage areas of 16 ft.×16 ft., 18 ft.×18 ft., and 20 ft.×20 ft. the maximum spacing is respectively: 16 ft., 18 ft., and 20 ft.

Figure 6A:
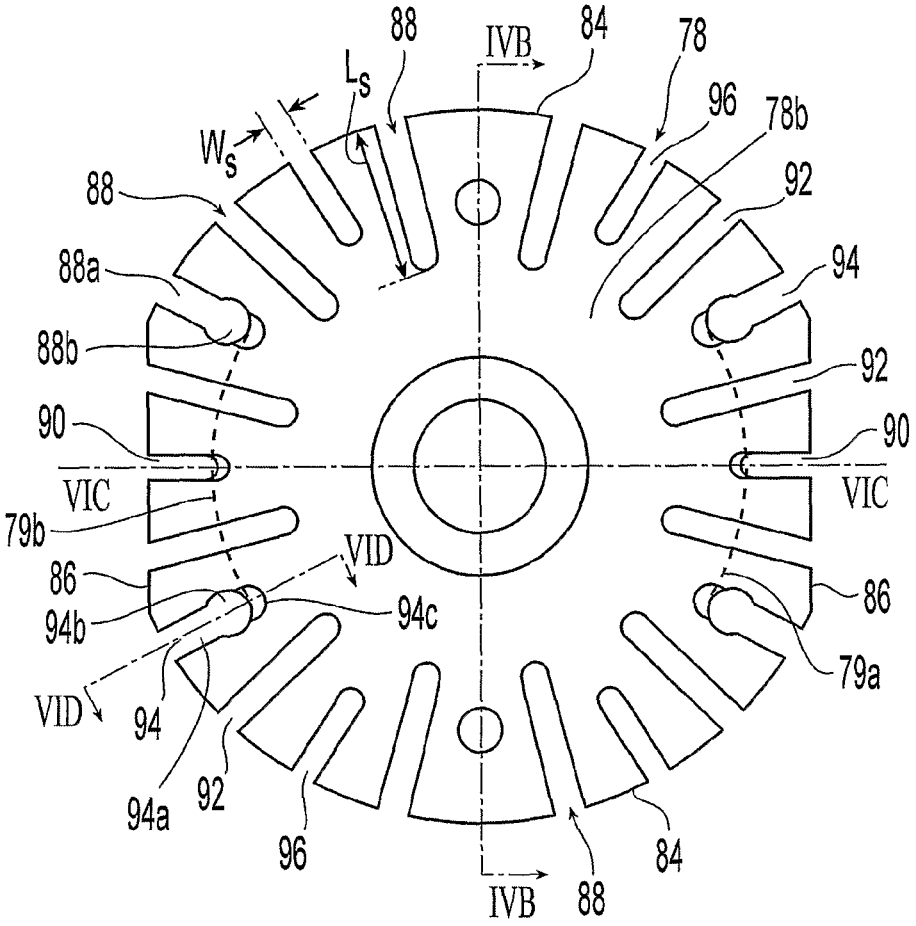
FIG. 6A is an alternate plan view of a preferred plate in the deflector plate assembly of FIG. 4A.
Figure 6B:
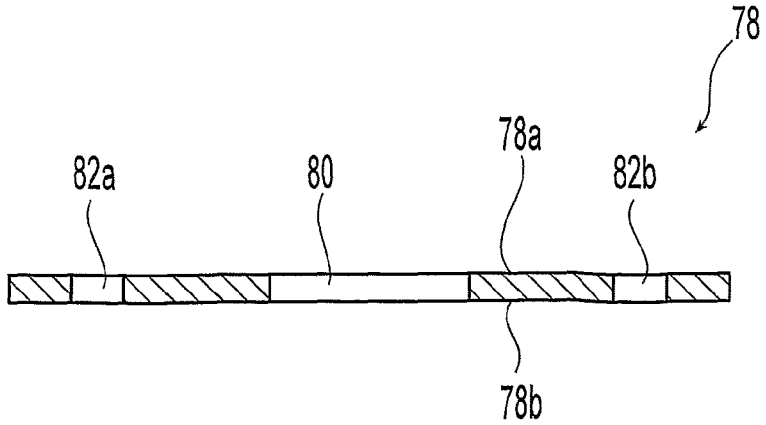
FIG. 6B is a cross-sectional view of the plate cut along line IVB-IVB in FIG. 6A
Figure 6C:
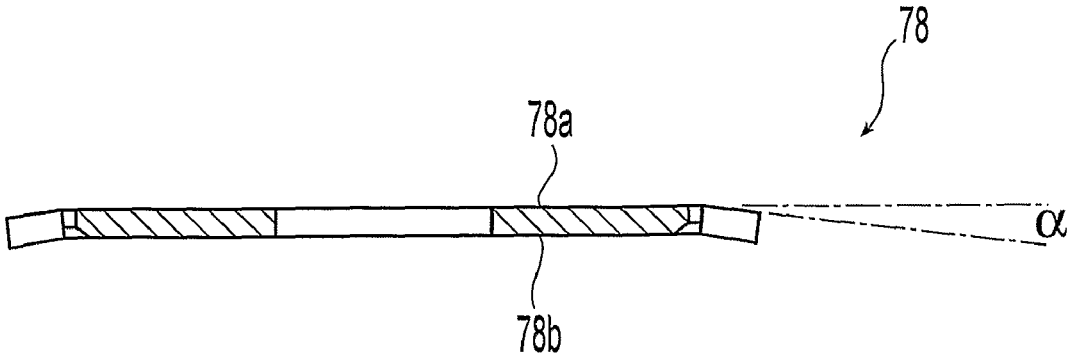
FIG. 6C is another cross-sectional view of the plate cut along the line VIC-VIC in FIG. 6A
Figure 6D:
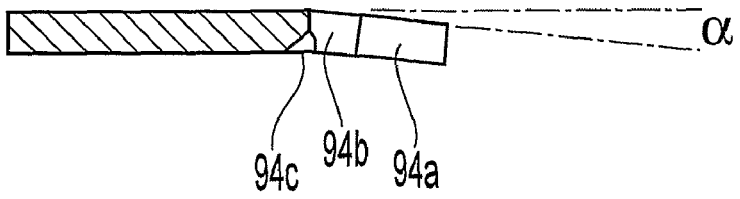
FIG. 6D is yet another cross-sectional view of the plate cut along the line VID-VID in FIG. 6A.

Shown generally in FIG. 4A and in greater detail in FIG. 6A, is the plate member 78 further including one or more slots 88 that define an opening or void extending from the upper surface 78*a* to the lower surface 78*b* to provide features for the distribution of a fluid flow. In addition, the slots 88 preferably initiate at the perimeter of the plate member 78 and extend radially toward the center of the plate member 78 to define a slot length $L_s$. Each of the slots 88 is preferably defined by a pair of spaced apart walls extending in the direction of slot elongation so as to define a slot width $W_s$. The slot to width ratio $W_s$:$L_s$ can range from about 0.1 to about 0.15. The slot width $W_s$ can vary along the length of the slot becoming wider or smaller at any portion of the slot along the slot length $L_s$. The walls defining the slots 88 can further taper relative to one or both of the upper and lower surfaces 78*a*, 78*b* or alternatively and more preferably be orthogonal to the upper and lower surfaces. Preferably, one or more of the slots 88 include a chamfer along at least a portion of at least one of the upper and lower surfaces 78*a*, 78*b*. The chamfers of sprinkler 10 can facilitate compliance with the flow collection requirements of the tests of UL 1626.

Any one of the slots 88 preferably includes a portion extending linearly so as to define a straight portion. The slot 88 can further include a non-linear portion, for example, defining a curve. More specifically, the spaced apart walls defining the slot 88 can curve along the slot length in a parallel fashion to define a curved slot. Alternatively, the walls defining the slot 88 can variably curve away and toward one another so as to substantially define an oblong shaped void in the plate member 78. Preferably, a portion of the walls defining the slot 88 curve relative to one another so as to define a circular bore or void along the slot 88. Accordingly, the slot 88 can be formed so as to include a linear portion and a non-linear portion in communication or continuous with the linear portion. Thus, the slot 88 can include a circular bore portion in communication with a straight portion. Moreover, the circular bore portion of the slot 88 can define a slot width that is greater than, or alternatively smaller than, the slot width of the straight portion. For example, as seen in FIG. 6A, a slot 88 can include a straight portion 88*a* in communication with and terminating radially inward at tip defined by a circular bore portion 88*b*. The circular bore portion 88*b* can include a countersink or alternatively include a counterbore. Moreover the slot 88 can include a series of portions of varying geometry along its slot length. For example, a preferred slot 94, as seen for example in FIGS. 6A and 6D, can include a first straight portion 94*a* defining a slot axis, a second circular bore portion 94*b* having a center along the slot axis, and a third circular bore portion 94*c* having a center along the slot axis spaced from the center of the second circular bore portion 94*b*. Circular bore portion 94*c* preferably has a smaller diameter than the second circular bore portion 94*b*. Moreover, any one of circular bores 94*b* and 94*c* can include a countersink or a counterbore. Accordingly, the slot width $W_s$ can vary along the slot length $L_s$ where, for example, the first straight portion 94*a* has a slot width, the second circular bore portion 94*b* has a second slot width greater than the first slot width and the third circular bore portion 94*c* has a third slot width smaller than the slot widths of the first straight and second circular bore portions 94*a*, 94*b*.

The preferred plate member 78 includes one or more pairs of diametrically opposed slots 88. More preferably, the plate member 78 includes one or more groups of diametrically opposed slots such as, for example, slot group 90, 92, 94 and 96. Each of the group of slots 90, 92, 94, 96 can vary from one another by varying any one of the previously described slot features. For example, the slot groups 90, 92, 94, 96 can each have a slot length $L_s$ each defining a ratio relative to the maximum radius of the plate member 78. In one preferred embodiment of the plate member 78, for example each of the first group of slots 90 defines a first ratio of about 0.25, each of the second group of slots 92 defining a second ratio of about 0.41, each of the third group of slots 94 defining a third ratio of about 0.23, and the fourth group of slots each defining a fourth ratio of about 0.29. Additional features may distinguish the groups of slots where for example, the third group of slots 94 includes a circular bore portion as described above. Any given group of slots is preferably periodically radially disposed about the plate member 78. The angular spacing between slots can range from about 15° to about 120° depending upon the number slots in the group and/or the desired spacing relative to the major axis IVB-IVB and minor axis VIC-VIC. More preferably, the groups of slots are further evenly interposed among one another such that a slot of a one group and a slot of another group are angularly spaced apart by about fifteen degrees (15°).

The various components of the sprinkler 10 including the body 12, the outer housing 14, the cover plate assembly 16, and the components of the deflector assembly can be made from any material capable of being machined, shaped, formed or fabricated provided the material can provide the requisite thermal responsiveness and fluid distribution characteristics. Preferably, materials for construction of the sprinkler components include brass, bronze, nickel, copper, steel, stainless steel or any combination thereof.

Accordingly, the preferred deflector plate assembly 42*a* and its features as described above can, alone or in combination with the remainder of the deflector assembly 42 and/or the outer housing 14 can be part of the means for distributing fluid in a residential dwelling unit so that the sprinkler 10 is able to meet testing requirements of UL 1626. In the horizontal distribution test, UL 1626, Section 26 requires placing the selected sprinkler 10 over a protective area sub-divided into four quadrants with the sprinkler 100 placed in the center of the quadrants I-IV. A detailed layout of one quadrant is illustrated in FIG. 7C. In this quadrant, water collection pans are placed over the quadrant (e.g., quadrant III) of the protective area so that each square foot of the quadrant is covered by collector pan of one-square foot area. For pendent sprinklers, the top of the collector pan is eight feet below a generally flat ceiling of the test area, as seen for example in FIG. 7A. The coverage area CA is generally the product of a coverage width CW and length CL, as seen in FIG. 7C, and can be for example, 16 feet by 16 feet, 18 feet by 18 feet, or 20 feet by 20 feet. The length L of the quadrant III is generally the one-half the coverage length CL and the width W is generally one-half the coverage width CW, where each square foot of the quadrant is covered by collection pans of one-square foot area with the top of each collection being about eight feet below a generally flat ceiling of the coverage area and the amount of fluid collected is at least 0.02 gallons per minute per square foot for any of the collection pans except that no more than four collection pans for each quadrant receive at least 0.015 gallons per minute per square foot.

In accordance with the test, water or another suitable fire fighting fluid is supplied to the selected sprinkler 10 at a desired rate with the sprinkler 10 being tested via a one-inch internal diameter pipe with a T-fitting having an outlet at substantially the same internal diameter as the inlet 24 of the selected sprinkler 100. The duration of the test is twenty-minutes and at the completion of the test, the water collected by the collection pan CP (as delineated by the square like grid) is measured to determine if the amount deposited complies with the minimum density requirement for each coverage area.

As promulgated by Section 27 of UL 1626, a vertical fluid distribution test provides for an arrangement to determine the vertical fluid distribution of any sprinkler suitable for the protection of a dwelling unit. In the test arrangement for the residential pendent sprinkler 100, the sprinkler 100 is placed over a center of a coverage area CA at one-half the coverage length CL or width CW (FIGS. 7A and 7B) of the coverage area. A suitable fire-fighting fluid such as water is delivered to the sprinkler 10 at a specified flow rate with the sprinkler 10 being tested via a one-inch internal diameter pipe. Water collection pans of one-square foot area are placed on the floor against the walls of the test area so that the top of the pan is six feet, ten inches below a nominally eight feet height H generally flat ceiling. The duration of the test is ten minutes at which point the walls within the coverage area should be wetted to within 28 inches of the ceiling at the specified design flow rate. Where the coverage area is square, each of the four walls must be wetted with at least five percent of the sprinkler flow. Where the coverage area is rectangular, each of the four walls must be wetted with a proportional water amount collected that is generally equal to 20 percent times a total discharge of the sprinkler 10 at the rated flow rate of the residential fire sprinkler times the length of the wall divided by the perimeter of coverage area CA.

As utilized in this test, the deflector assembly 42 including the slots 88 of the plate member 78 is believed to allow the break up of the flow stream extending from the outlet 26 perpendicular to the frame arms 14 in order to meet a maximum 20-foot spacing between sprinklers in the operational test of Section 22 of UL 1626. The preferred plate member 78 in combination with the projection member 60 is believed to provide for a sufficient fluid distribution over the test coverage area perpendicular to the longitudinal axis A-A. Further, it is believed that the features described above in relation to the deflector assembly 42 allows the sprinkler 10 to provide an operating flow rate of thirteen gallons per minute (13 gpm) of water at an operating pressure of about seven pounds per square inch gauge (7 psig.) fed to the inlet 26 so that a density of at least 0.05 gpm/ft$^2$ of fluid is provided to a coverage area of 16 feet by 16 feet under at least the horizontal distribution test of UL 1626.

Moreover, the above described features provide a sprinkler performance in the preferred sprinkler 10 having a minimal operating flow of seventeen gallons per minute (17 gpm) in a successful fluid distribution and fire tests for a 324 square feet area (18 ft.×18 ft.), and a minimal operating flow of twenty gallons per minute (20 gpm) for a 400 square foot test area (20 ft.×20 ft.). More preferably, the sprinkler 10 can provide a minimal flow of seventeen gallons per minute (17 gpm) in successful fluid distribution and fire tests for a 324 square feet area (18 ft.×18 ft.) at an operating pressure of about twelve pounds per square inch (12 psi.), and further provide a minimal flow of twenty gallons per minute (20 gpm.) for a 400 square foot test area (20 ft.×20 ft.) at less than seventeen pounds per square inch and even more preferably at an operating pressure of about 16.7 psi.

Besides the above described fluid distribution tests, actual fire tests can also be performed in accordance with Section 28 of UL 1626 for the preferred embodiments. In particular, a fire test can be performed with sprinkler 10 to limit the temperature in a location of the test area so as to satisfy the criteria of Section 28.1 of UL 1626. More specifically, a test area can be constructed with the preferred sprinklers 10 installed in accordance with Section 28.2 of UL 1626. Actual fire tests conducted with sprinkler 10 can limit temperatures for each rated spacing as specified by the installation requirements having no more than two sprinklers 10 operate, such that: (i) the maximum temperature three inches below the ceiling at the tested locations does not exceed 600° F. (316° C.); (ii) the maximum temperature five and one-quarter feet (5¼ ft.) above the floor shall not exceed 200° F. nor exceed 130° F. for more than any continuous two minute period; and (iii) the maximum ceiling temperature ¼ inch behind the finished ceiling surface shall not exceed 500° F. (260° C.).

As a preferably concealed pendent sprinkler, the sprinkler 10 provides for as much vertical adjustment ranging from about ¼ inch to about ¾ inch and preferably about ½ inch when installing the sprinkler in a sprinkler system 100 relative to a fixed pipe drop. This vertical adjustment can reduce the accuracy to which fixed pipe drops of system 100 must be cut to ensure a proper installation.

Finally, because the preferred embodiments of the sprinkler 100 are able to pass all of the performance tests required by UL 1626, the preferred embodiments are able to be listed by a listing authority, such as, for example, UL, for design and installation as a residential fire sprinkler, as defined in Section 3.6.2.10 of NFPA 13. The above described features of the preferred embodiment of the sprinkler 10 can, in a residential fire protection system, as per NFPA 13, 13D and 13R, provide an optimized fire protection at lower minimum design pressures for design protection area of 144 square feet or greater. Consequently, at least the deflector assembly 42 alone or in combination with the other operational components of the sprinkler 10, preferably provides the means for distributing fluid over a coverage area of a residential dwelling unit. Thus, the sprinkler 10 can be installed in a preferably wet residential sprinkler system in accordance with the NFPA Standards to provide a suitable fluid density over a maximum coverage area of 256 square feet or less in which the sprinkler 10 has a minimum discharge flow rate of about thirteen gallons per minute (13 gpm) and a minimum design or an operating pressure of about seven pounds per square inch delivered to the sprinkler. In addition, the preferred sprinkler 10 can be installed in a residential sprinkler system for a maximum coverage area of about 324 square feet, given that the sprinkler 10 can deliver a minimum flow rate of about seventeen gallons per minute (17 gpm) at a minimum design pressure of about twelve pounds per square inch (12 psi) and further provide for a maximum coverage area of about four hundred square feet (400 ft.$^2$) given that the sprinkler 10 can deliver a minimum flow rate of about twenty gallons per minute (20 gpm) at a minimum design pressure of about seventeen pounds per square inch (17 psi). More specifically, with the lower minimum operating design pressures, the preferred embodiments can be utilized in the design of fire protection system for coverage area of 324 square feet or greater at approximately a fifteen percent lower design pressure than known residential fire sprinklers. Accordingly, the sprinkler 10 provides a preferred device and method for protecting a coverage area that can range from about 144 square feet to about 400 square feet by introducing a fire fighting fluid to the sprinkler body 12 at a minimum operating pressure ranging from about seven pounds per square inch to about seventeen pounds per square inch (7-17 psi). The preferred device and method further provide for discharging the fluid from the sprinkler body 12 at a flow rate ranging from about thirteen gallons per minute to about 20 gallons per minute (13-20 gpm) and distributing the fluid over the coverage area at a density of about 0.05 gallons per minute per square foot (0.05 gpm/ft$^2$).

One preferred embodiment of the sprinkler 10 is shown and described in *Tyco Fire & Building Product Data Sheet Series LFII Residential Concealed Pendent Sprinklers, Flat Plate* 4.9 *K* (January 2006) which is incorporated in its entirety herein by reference thereto. Shown below is a tabulated summary of the minimum flow and residual pressures for the preferred sprinkler having a 160° F. (71° C.) temperature rating for various coverage areas. In addition, the preferred sprinkler can provide for a maximum working pressure of about 175 pounds per square inch (175 psi.)

TABLE 1

| Maximum Coverage Area | Maximum Sprinkler Spacing (feet) | Minimum Flow (gpm) & Residual Pressure (psi) |
|---|---|---|
| 12 ft. × 12 ft. | 12 ft. | 13 gpm./7 (psi.) |
| 14 ft. × 14 ft. | 14 ft. | 13 gpm./7 (psi.) |
| 16 ft. × 16 ft. | 16 ft. | 13 gpm./7 (psi.) |
| 18 ft. × 18 ft. | 18 ft. | 17 gpm./12 (psi.) |
| 20 ft. × 20 ft. | 20 ft. | 20 gpm./16.7 (psi.) |

Table 1 provides for various maximum coverage areas for the preferred sprinkler 10 and further provides preferred minimal flow rates and operating fluid pressure. The provided minimal flow rates and operating pressures can also be used for a sprinkler 10 used to protect a coverage area having dimensions less than or between those indicated so as to ensure adequate distribution density for the actual coverage area.

While the present invention has been disclosed with reference to certain preferred embodiments, numerous modifications, alterations, and changes to the described embodiments are possible without departing from the sphere and scope of the present invention, as described herein. Accordingly, it is intended that the present invention not be limited to the described embodiments, but that it have the full scope defined by the language of the following claims, and equivalents thereof.

What I claim is:

1. A residential flat plate concealed sprinkler for the fire protection of an area ranging from about 144 square feet to about 400 square feet, the sprinkler comprising: an outer housing having an inner surface defining a chamber; a body at least partially disposed within the chamber, the body having an inlet and an outlet spaced along a longitudinal axis, the outlet having a minimum design fluid flow ranging from about thirteen gallons per minute to about twenty gallons per minute (13-20gpm) and the inlet having a minimum design input fluid pressure ranging from about seven pounds per square inch to about seventeen pounds per square inch (7-17 psi.), the body including an inner surface defining a passageway for communication between the inlet and the outlet; at least one guide member having a proximal end and a distal end, the proximal end being coupled to the body and the distal end having telescopic movement relative to the outlet in direction parallel to the longitudinal axis; and a deflector assembly for distributing a flow of fluid over the protected area, the protection area ranging from about 144 square feet to about 400 square feet (144-400 ft.$^2$), the fluid distribution having a density of at least 0.05 gallons per minute per square foot (0.05 gpm/ft$^2$) for a minimum operating pressure and a minimum operating fluid flow each being a function of the size of the protection area, the minimum operating pressures ranging from about seven pounds per square inch to about seventeen pounds per square inch (7-17 psi.) and the range of minimum operating fluid flows ranging from about thirteen gallons per minute to about twenty gallons per minute (13-20gpm), the deflector assembly being coupled to the distal end of the at least one guide member so that the deflector assembly has a first position distal of the outlet and a second position distal of the first position, the deflector assembly including in each of the first and second positions: a plate member; a projection member coupled to the plate member, wherein the protection member and the plate member defines a proximal surface substantially orthogonal to the longitudinal axis and spaced axially from the outlet, a distal surface of the proximal surface and orthogonal to the longitudinal axis, arid an intermediate surface between the proximal surface and the distal surface, the intermediate surface being substantially orthogonal to the longitudinal axis, the distal surface defining an substantially oval perimeter circumscribed about the longitudinal axis and further including a plurality, of slots substantially equiradially spaced about the longitudinal axis, each slot having a substantially straight portion initiating from the perimeter and extending radially toward the longitudinal taxis to define a slot length and further having a slot width, the plurality of slots also further defining a first slot group having a first slot length; and at least a second slot group having a second slot length smaller than the first slot length.

2. The sprinkler of claim 1, wherein the projection member defines the intermediate surface disposed between the proximal and the distal surfaces.

3. The sprinkler of claim 2, wherein the intermediate surface includes a first portion orthogonal to the longitudinal axis and second portion oblique to the longitudinal axis.

4. The sprinkler of claim 2, wherein at least a portion of the plate member forms the distal surface.

5. The sprinkler of claim 2, wherein the projection member has a core aligned with the longitudinal axis, the core having a substantially planar tip forming the proximal surface, the projection member further including at least one lateral member extending radially from the core, the at least one lateral member defining the intermediate surface.

6. The sprinkler of claim 5, wherein the projection member includes a surface circumscribed about the longitudinal axis to define an oblique surface relative plane perpendicular to the longitudinal axis.

7. The sprinkler of claim 1, wherein the plate member includes at least one arcuate edge and at least one substantially straight edge.

8. The sprinkler of claim 7, wherein the at least one arcuate edge is spaced from the longitudinal axis and the at least one straight edge substantially perpendicular to the longitudinal axis.

9. The residential sprinkler of claim 1, wherein the plate member defines a center point along the longitudinal axis and a maximum radius circumscribed about the center point to define a circle, the plate having a first pair of diametrically opposed edges disposed along the circle and a second pair of diametrically opposed edges each defining a chord of the circle.

10. The sprinkler of claim 1, wherein at least one slot of the groups of slots includes a first portion having a first slot width and a second portion having a second slot width greater than the first slot width.

11. The residential sprinkler of claim 1, wherein at least one of the plurality of slots includes a substantially circular portion in communication with the straight portion, the circular portion having a width greater than the straight portion.

12. The residential sprinkler of claim 1, wherein at least one slot of the first slot group is disposed between two slots of the second slot group.

13. The sprinkler of claim 1, wherein the plate member has an upper surface and an opposite lower surface, the plurality of slots being formed in the plate member and each slot extending from the upper surface to the lower surface, at least one of the plurality of slots including a straight portion and a circular portion in communication with the straight portion.

14. The sprinkler of claim 13, wherein the circular portion includes at least one of a counterbore and a countersink.

15. The residential sprinkler of claim 13, wherein at least one of the upper and lower surfaces includes a first portion disposed in a first plane and a second portion disposed in a second plane angled relative to the first plane.

16. The residential sprinkler of claim 15, wherein the second portion further defines a straight perimeter edge of the plate member.

17. The residential sprinkler of claim 16, wherein the body further comprises a flange circumscribing the outlet and an inner housing disposed about the flange, the inner housing being coaxially disposed within the outer housing and including an inner surface defining a chamber extending along the longitudinal axis, the proximal end of the guide member being coupled to the inner surface of the inner housing.

18. The sprinkler of claim 1, further comprising a cover plate assembly having a first state coupled to the outer housing to retain the deflector assembly in the first position and a second state detached from the housing to release the deflector assembly into the second position.

19. The residential sprinkler of claim 18, wherein the plate assembly comprises:

a retaining sleeve having a coupling mechanism to couple the plate assembly to the outer housing, the retaining sleeve having an inner surface defining a passageway with an inlet and an outlet spaced along the longitudinal axis;

a cover plate member disposed adjacent the outlet of the retaining sleeve to support and conceal at least a portion of the deflector assembly within the passageway of the retaining sleeve, the cover plate including a thermally responsive coupling to couple the cover plate to the retaining sleeve adjacent the outlet of the retaining sleeve.

20. The residential sprinkler of claim 18, wherein the thermally responsive coupling is at least one solder element having a rating of about 135° F. (57° C.).

21. The residential sprinkler of claim 1, wherein the sprinkler has a temperature rating of about 160° F. (71° C.).

22. The residential sprinkler of claim 18, wherein the plate assembly further comprises an ejection spring to bias the plate from the retaining sleeve.

23. The residential sprinkler of claim 18, wherein inner surface of the outer housing includes a thread, the coupling mechanism of the retaining sleeve being a projection to mate with the thread of the inner surface of the outer housing.

24. The sprinkler of claim 18, wherein the deflector assembly defines a fluid distribution including a distribution density for the protected area in accordance with UL Standard 1626 (October 2003).

25. The sprinkler of claim 24, wherein the protected areas is about 256 square feet (256 $ft^2$), the distribution density is at least 0.05 gallons per minute per square foot (0.05 gpm/$ft^2$) in response to a fluid flow of about thirteen gallons per minute (13 gpm) and an incoming fluid pressure of about seven pounds per square inch (7 psi.).

26. The sprinkler of claim 24, wherein the protected areas is about 324 square feet (324 $ft^2$), the distribution density is at least 0.05 gallons per minute per square foot (0.05 gpm/$ft^2$) in response to a fluid flow of about seventeen gallons per minute (17 gpm) and an incoming fluid pressure of about twelve pounds per square inch (12 psi.).

27. The sprinkler of claim 24, wherein the protected areas is about 400 square feet (400 $ft^2$), the distribution density is at least 0.05 gallons per minute per square foot (0.05 gpm/$ft^2$) in response to a fluid flow of about twenty gallons per minute (20 gpm) and an incoming fluid pressure of about seventeen pounds per square inch (17 psi.).

28. A residential pendent concealed sprinkler comprising:

an outer housing and an inner housing coaxially aligned along a longitudinal axis; a body having at least a portion disposed in the inner and outer housing, the body having an inner surface defining a passageway including an inlet and an outlet spaced apart along the longitudinal axis and defining a K-factor of about 5, a closure assembly to occlude the outlet; a thermally responsive trigger element having a first state aligned with the longitudinal axis to support the closure assembly adjacent the outlet and a second state to displace the closure assembly from the outlet; a deflector assembly having a first position distal of the outlet and a second position distal of the first position, the deflector assembly including in each of the first position and second position: a plurality of deflecting surfaces substantially perpendicular to the longitudinal axis, the plurality of deflecting surfaces including at least a proximal surface, a distal surface and an intermediate surface and a plurality of slots in at least one of the deflecting surfaces to provide a distribution of a fluid over a protection area ranging from about 144 square feet to about 400 square feet (144-400 $ft.^2$), the fluid distribution having a density of at least 0.05 gallons per minute per square foot (0.05 gpm/$ft^2$) for a minimum operating pressure and a minimum operating fluid flow each being a function of the size of the protection area, the minimum operating pressures ranging from about seven pounds per square inch to about seventeen pounds per square inch (7-17 psi.) and the range of minimum operating fluid flows ranging from about thirteen gallons per minute to about twenty gallons per minute (13-20 gpm).

29. The sprinkler of claim 28, further comprising at least one axially extending guide member having a first portion and a second portion, the first portion of the guide member being coupled to the inner housing so that a second portion of the guide member has axial movement relative to the outlet of the body, the deflector assembly being coupled to the second portion of the guide member.

30. The sprinkler of claim 29, wherein a portion of the deflector assembly and the second portion of the guide member define a fluid flow channel.

31. The sprinkler of claim 28, wherein the deflector assembly has a first position distal of the outlet defining a minimal distance between the outlet of the body and the deflector assembly, the deflector assembly having a second position distal of the first position defining the maximum distance between the outlet of the body and the deflector assembly.

32. The sprinkler of claim 28, further comprising a cover plate assembly having a cover plate and a thermally responsive fastener coupling the cover plate to the outer housing such that the cover plate engages the deflector assembly and contains the deflector assembly within the outer housing.

33. The sprinkler of claim 28, wherein the plurality of surfaces includes a proximal surface, a distal surface and at least one intermediate surface disposed between the proximal and distal surfaces.

34. The sprinkler of claim 33, wherein the intermediate surface includes a portion oblique to the longitudinal axis.

35. The sprinkler of claim 28, wherein the deflector assembly comprises a deflector plate substantially perpendicular to the longitudinal axis.

36. The sprinkler of claim 35, wherein the deflector assembly further comprises a projection member engaged with the deflector plate, the projection member having a core aligned with the longitudinal axis and at least one lateral member extending radially from the core, the at least one lateral member defining the intermediate surface.

37. The sprinkler of claim 35, wherein the projection member includes a surface circumscribed about the longitudinal axis to define an oblique surface relative plane perpendicular to the longitudinal axis.

38. The sprinkler of claim 35, wherein the radially extending lateral member includes an end having a void defined therein.

39. The sprinkler of claim 38, further comprising a guide member coupled to the deflector assembly to provide relative axial movement, the guide member being spaced from the lateral member so as to form a fluid flow channel between the end of the lateral member and the guide member.

40. The sprinkler of claim 28, wherein the deflector assembly comprises a plate having at least one arcuate edge and at least one substantially straight edge.

41. The sprinkler of claim 40, wherein the at least one arcuate edge is equiradially spaced from the longitudinal axis and the at least one straight edge extends along a line substantially perpendicular to the longitudinal axis.

42. The sprinkler of claim 40, wherein the plate defines a center point along the longitudinal axis and a maximum radius circumscribed about the center point to define a circle, the plate having a first pair of diametrically opposed edges disposed along the circle and a second pair of diametrically opposed edges each defining a chord of the circle.

43. The sprinkler of claim 28, wherein at least one of the plurality of slots includes a first portion having a first slot width and a second portion having a second slot width greater than the first slot width.

44. The sprinkler of claim 28, wherein at least one of the plurality of slots includes a straight portion and a substantially circular portion in communication with the straight portion, the circular portion having a width greater than the straight portion.

45. The sprinkler of claim 28, wherein the deflector assembly comprises a plate substantially perpendicular to the longitudinal axis, the deflector plate having an upper surface and an opposite lower surface, the plurality of slots being formed in the plate and each slot extending from the upper surface to the lower surface, at least one of the plurality of slots including a straight portion and a substantially circular bore portion in communication with the straight portion.

46. The sprinkler of claim 45, wherein the substantially circular bore portion has a slot width greater than the slot width of the straight portion.

47. The sprinkler of claim 45, wherein the circular bore portion includes at least one of a counterbore and countersink.

48. The sprinkler of claim 45, wherein at least one of the upper and lower surfaces includes a first portion disposed in a first plane and a second portion disposed in a second plane angled relative to the first plane.

49. The sprinkler of claim 28, further comprising a cover plate assembly having first state coupled to the outer housing to retain the deflector assembly in a non-deployed position and a second state detached from the housing to release the deflector assembly to a deployed state.

50. The sprinkler of claim 49, wherein the cover plate assembly comprises:

a retaining sleeve having a coupling mechanism to couple the cover plate assembly to the outer housing, the retaining sleeve having an inner surface defining an passageway with an inlet and an outlet spaced along the longitudinal axis;

a plate disposed adjacent the outlet of the retaining sleeve to support and conceal at least a portion of the deflector assembly within the passageway of the retaining sleeve, the plate including a thermally responsive coupling to couple the plate to the retaining sleeve adjacent the outlet.

51. The sprinkler of claim 50, wherein the thermally responsive coupling is at least one solder element having a rating of about 135° F. (57° C.).

52. The sprinkler of claim 50, wherein the plate assembly further comprises an ejection spring to bias the plate from the retaining sleeve.

53. The sprinkler of claim 28, wherein the sprinkler has a temperature rating of about 160° F. (71° C.).

54. The sprinkler of claim 50, wherein inner surface of the outer housing includes a thread, the coupling mechanism of the retaining sleeve being a projection to mate with the thread of the inner surface of the outer housing.

55. The sprinkler of claim 28, wherein the protection area is about 256 square feet (256 $ft^2$), the minimum operating fluid flow being about thirteen gallons per minute (13 gpm) and the minimum operating pressure being about seven pounds per square inch (7 psi.).

56. The sprinkler of claim 28, wherein the protection area is about 324 square feet (324 $ft^2$), the minimum operating fluid flow being about seventeen gallons per minute (17 gpm) and the minimum operating pressure being about twelve pounds per square inch (12 psi.).

57. The sprinkler of claim 28, wherein the protection area is about 400 square feet (400 $ft^2$), the minimum operating fluid flow being about twenty gallons per minute (20 gpm) and the minimum operating pressure being about seventeen pounds per square inch (17 psi.).

58. A residential sprinkler comprising: a body having an inner surface defining a passageway for carrying a fluid, the passageway including an inlet and an outlet spaced apart along the longitudinal axis and defining a K-factor of about 5; a closure assembly adjacent the outlet to occlude the outlet; a deflector assembly having a first position distal of the outlet and a second position distal of the first position, the deflector assembly including a plate having a substantially oval outer perimeter and having a first plate axis and a second plate axis, the distance between portions of the substantially oval outer perimeter along the first axis being greater than the distance between portions of the substantially oval outer perimeter along the second axis, a plurality of slots disposed along the substantially oval outer perimeter, the plurality of slots disposed on either side of the first plate axis and the second plate axis further defining a first slot group having a first slot length, and at least a second slot group having a second slot length smaller than the first slot length, the plurality of slots including a pair of adjacent slots having one slot of each of the pair of adjacent slots adjacent the first plate axis, and a pair of opposed slots disposed on the second slot axis; and a projection coupled to the plate in each of the first position distal to the outlet and the second position distal to the first position; a pair of telescopic guide members each having a proximal end and a distal end, the proximal end being coupled to the body, the distal end of the guide members coupled to the plate along the first plate axis between the pair of slots and adjacent an edge that forms each of the slot of each of the pair of slots; wherein the deflector assembly distributes a flow of fluid over a protection area ranging from about 144 square feet to about 400 square feet, the fluid distribution having a density of at least 0.05 gallons per minute per square foot (0.05 gpm/ft$^2$) so as to define a range of minimum operating pressures ranging from about seven pounds per square inch to about seventeen pounds per square inch (7-17 psi.) and a range of minimum operating fluid flows ranging from about thirteen gallons per minute to about twenty gallons per minute (13-20 gpm), wherein the protection area is about 324 square feet (324 ft$^2$), the minimum operating fluid flow being about seventeen gallons per minute (17 gpm) and the minimum operating pressure being about twelve pounds per square inch (12 psi.); and wherein the protection area is about 400 square feet (400 ft$^2$), the minimum operating fluid flow being about twenty, gallons per minute (70 gpm) and the minimum operating pressure being about seventeen pounds per square inch (17 psi.); and a thermally responsive-trigger assembly that maintains the closure assembly adjacent the outlet the trigger assembly having a fusible link assembly spaced from the proiection when the deflector assembly is in the first position.

59. The sprinkler of claim 58, further comprising a thermally responsive plate means for maintaining a minimum spacing between the outlet and deflector.

60. The sprinkler of claim 59, further comprising an outer housing wherein the thermally responsive plate means comprise a cover plate assembly having a cover plate and a thermally responsive fastener coupling the cover plate to the outer housing such that the cover plate engages the deflector assembly and contains the deflector assembly within the outer housing.

61. The sprinkler of claim 60, wherein the cover plate assembly comprises:

a retaining sleeve having a coupling mechanism to couple the cover plate assembly to the outer housing, the retaining sleeve having an inner surface defining an passageway with an inlet and an outlet spaced along the longitudinal axis;

the cover plate being disposed adjacent the outlet of the retaining sleeve to support and conceal at least a portion of the deflector assembly within the passageway of the retaining sleeve.

62. The sprinkler of claim 61, wherein the thermally responsive fastener coupling is at least one solder element having a rating of about 135° F. (57° C.).

63. The sprinkler of claim 61, wherein the cover plate assembly further comprises an ejection spring to bias the plate from the retaining sleeve.

64. The sprinkler of claim 58, wherein the deflector assembly further comprises:

a pair of telescopic guide members each having a proximal end and a distal end, the proximal end being coupled to the body; and wherein the plate is coupled to the distal ends of the guide members.

65. The sprinkler of claim 58, wherein the first position comprises a position distal of the outlet defining a minimal distance between the outlet of the body and the deflector assembly, and the second position comprises a position distal of the first position defining the maximum distance between the outlet of the body and the deflector assembly.

66. The sprinkler of claim 58, wherein the deflector assembly comprises a plurality of surfaces distal the outlet of the body, the plurality of surfaces including a proximal surface, a distal surface and at least one intermediate surface disposed between the proximal and distal surfaces.

67. The sprinkler of claim 66, wherein the intermediate surface includes a portion oblique to the longitudinal axis.

68. The sprinkler of claim 58, wherein the plate comprises a surface substantially perpendicular to the longitudinal axis.

69. The sprinkler of claim 68, wherein the plate has at least one arcuate edge and at least one substantially straight edge.

70. The sprinkler of claim 69, wherein the at least one arcuate edge is equiradially spaced from the longitudinal axis and the at least one straight edge extends along a line substantially perpendicular to the longitudinal axis.

71. The sprinkler of claim 68, wherein the plate defines a center point along the longitudinal axis and a maximum radius circumscribed about the center point to define a circle, the plate having a first pair of diametrically opposed edges disposed along the circle and a second pair of diametrically opposed edges each defining a chord of the circle.

72. The sprinkler of claim 58, wherein the projection member is engaged with the plate, the projection member having a core aligned with the longitudinal axis and at least one lateral member extending radially from the core.

73. The sprinkler of claim 72, wherein the projection member includes a surface circumscribed about the longitudinal axis to define an oblique surface relative plane perpendicular to the longitudinal axis.

74. The sprinkler of claim 72, wherein the radially extending lateral member includes an end having a void defined therein.

75. The sprinkler of claim 58, wherein the plate has a plurality of slots, wherein at least one of the plurality of slots includes a first portion having a first slot width and a second portion having a second slot width different than the first slot width.

76. The sprinkler of claim 75, wherein at least one of the plurality of slots includes a straight portion and a substantially circular portion in communication with the straight portion, the circular portion having a width greater than the straight portion.

77. The sprinkler of claim 76, wherein the circular portion includes at least one of a counterbore and countersink.

78. The sprinkler of claim 75, wherein the plate includes an upper surface and a lower surface, at least one of the upper and lower surfaces includes a first portion disposed in a first plane and a second portion disposed in a second plane angled relative to the first plane.

79. The sprinkler of claim 58, wherein the sprinkler has a temperature rating of about 160° F. (71° C.).

* * * * *

UNITED STATES PATENT AND TRADEMARK OFFICE

CERTIFICATE OF CORRECTION

PATENT NO. : 8,353,356 B2
APPLICATION NO. : 11/916405
DATED : January 15, 2013
INVENTOR(S) : Kenneth W. Rogers It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 935 days.

Signed and Sealed this
First Day of September, 2015

Michelle K. Lee

Michelle K. Lee
*Director of the United States Patent and Trademark Office*